US005400119A

United States Patent [19]

Kusuda et al.

[11] Patent Number: 5,400,119

[45] Date of Patent: Mar. 21, 1995

[54] IMAGE FORMING APPARATUS

[75] Inventors: Toshiaki Kusuda, Hyogo; Ikuo Makie, Osaka; Yoshihisa Tanaka, Osaka; Yukihiro Aikawa, Osaka; Satoshi Ishii, Osaka, all of Japan

[73] Assignee: Mita Industrial Co., Ltd., Osaka, Japan

[21] Appl. No.: 873,942

[22] Filed: Apr. 27, 1992

[30] Foreign Application Priority Data

Apr. 30, 1991 [JP] Japan ..... 3-099263

[51] Int. Cl.[6] ..... G03G 21/00

[52] U.S. Cl. ..... 355/200; 355/202; 355/308

[58] Field of Search ..... 271/272; 355/200, 202, 355/206, 308, 309, 311; 346/160.1

[56] References Cited

U.S. PATENT DOCUMENTS

| | | | |
|---|---|---|---|
| 4,260,904 | 4/1981 | Horie et al. | 355/206 |
| 4,335,950 | 6/1982 | Gunzelmann et al. . | |
| 4,893,549 | 10/1989 | Tada et al. | 355/206 |
| 4,896,190 | 1/1990 | Uchida et al. | 355/202 |
| 4,951,090 | 8/1990 | Matsumoto et al. | 355/200 |
| 4,969,010 | 11/1990 | Tamura et al. | 355/200 X |
| 4,970,553 | 11/1990 | Orlowski et al. | 355/200 |
| 5,005,053 | 4/1991 | Kozuka | 355/200 X |
| 5,073,796 | 12/1991 | Suzuki et al. | 355/30 X |
| 5,136,329 | 8/1992 | Sugiura | 355/200 X |

FOREIGN PATENT DOCUMENTS

| | | |
|---|---|---|
| 0271090 | 6/1988 | European Pat. Off. . |
| 0271720 | 6/1988 | European Pat. Off. . |
| 0460659 | 12/1991 | European Pat. Off. . |
| 0503610 | 9/1992 | European Pat. Off. . |
| 2611391 | 9/1988 | France . |
| 2611393 | 9/1988 | France . |
| 02-215666 | 8/1990 | Japan . |
| 2177976 | 2/1987 | United Kingdom . |

OTHER PUBLICATIONS

Patent Abstracts of Japan, Pub. No. JP 221566, Aug. 28, 1990 to Kasunobu, which relates to Jap. Pat. Appl. No. JP8900034242.

Machine Design, vol. 59, No. 5, Mar. 12, 1987 (author unknow to Applicants).

Patent Abstracts of Japan, vol. 7, No. 231 (P-229) (1376), Oct. 13, 1983 to Nishino, which relates to Jap. Pat. Appl. No. 58-118659.

Patent Abstracts of Japan, Pub. No. JP63202765 (Aug. 22, 1988) to Kyohei et al., relating to Japanese Pat. App. No. JP870036332.

Patent Abstracts of Japan, Pub. No. JP2216170 (Aug. 29, 1990) to Jun et al., relating to Japanese Pat. App. No. JP890037555.

Patent Abstracts of Japan, vol. 9, No. 141 (P-364) (1864) dated Jun. 15, 1985 to Nakamura, relating to Japanese Pat. App. No. 58-128948.

Patent Abstracts of Japan, Pub. No. JP3050564 (Mar. 5, 1991) to Seiji, relating to Japanese Pat. App. No. JP890184821.

*Primary Examiner*—George H. Miller, Jr.
*Assistant Examiner*—John Barlow
*Attorney, Agent, or Firm*—Beveridge, DeGrandi, Weilacher & Young

[57] ABSTRACT

An image forming apparatus is disclosed having a main body made of resin formed in a monocoque structure. The main body incorporates the functional components and is formed from separable upper and lower casings. The functional components of the apparatus are held by the casings. A document delivery device is located on the upper part of the upper casing. This delivery device includes a pair of delivery rollers for delivering a document along the top surface of the upper casing with the document held by and between the delivery rollers. The image forming apparatus further includes electrical connections which prevent the upper and lower casings from being separated from one another while electrical power is being supplied to the apparatus.

14 Claims, 40 Drawing Sheets

IMAGE FORMING APPARATUS

BACKGROUND OF THE INVENTION

There is known an image forming apparatus such as an electrophotographic copying apparatus, a facsimile or the like of the electrostatic type in which an electrostatic latent image formed on the surface of a photosensitive drum is converted into a toner image, which is then transferred to paper. As such an image forming apparatus, there is proposed a very small-size apparatus of the so-called portable type (for example, Japanese Patent Publication 17453/1990).

An image forming apparatus of the type above-mentioned comprises a variety of functional components respectively forming:

optical means for illuminating a document and for guiding light reflected from the document;

image forming means for forming an electrostatic latent image on a photoreceptor by the reflected light guided from the optical means, for converting the electrostatic latent image into a toner image and for transferring the toner image to paper;

paper delivery means including a fixing unit for fixing the toner image transferred to the paper, the paper delivery means being adapted to introduce paper into the main body of the apparatus and for discharging the paper from the main body after the paper has been fed to the image forming means;

drive means for driving the means above-mentioned; and electric components.

The functional components are attached to metallic reinforcing frames such as a pair of lateral plates, stays for connecting the lateral plates to each other, or the like, disposed in a box-like casing formed by a resin molded body.

To spread the image forming apparatus having the arrangement above-mentioned for family and personal uses, it is desired to minimize the sizes and weight of such apparatus with the production and sales costs reduced. However, the conventional image forming apparatus requires reinforcing frames to which the functional components are attached. This accordingly increases the number of component elements, failing to make an economical apparatus in a compact and lightweight design. Further, extra steps of assembling the reinforcing frames are required, thus further increasing the production cost.

When the apparatus is made in a compact and lightweight design, the apparatus can be optionally carried by anybody. This increases the likelihood that the apparatus may be struck or let fall so that an excessive shock is exerted thereto. If an excessive shock is exerted to the apparatus, the apparatus is liable to present, particularly at the joint parts of the apparatus body with the reinforcing frames, breakages such as cracks, plastic deformation and the like due to the difference in material nature and strength between the apparatus body and the reinforcing frames.

In an electrophotographic copying apparatus, there are available two types of document delivery systems, i.e., a so-called document-rack-movable type in which a document rack on which a document is placed is moved to deliver the document, and a so-called roller-delivery type in which a document as held by and between a pair of upper and lower rollers is delivered. In the former type, it is required to dispose, on the top of the apparatus body, a document rack having a size large enough for a document that is placed on the document rack. This inevitably requires, as the plane area for installing the apparatus, a space greater than the sizes of a document. Accordingly, the sizes of the apparatus cannot be minimized as desired. Further, if the document rack under movement comes in contact with an obstacle, the apparatus is liable to become defective in operation and cause troubles. In order to avoid the problems above-mentioned, it is required to securely provide a document-rack moving space around the apparatus. Thus, the apparatus is restricted by requiring a large installation place.

In the roller-delivery type, the length of the document delivery means along the document delivery direction can be made shorter than the length of a document. Accordingly, the main body of the apparatus can be reduced in plane area and consequently made smaller than that of the document-rack-movable type. Even though a document under delivery comes in contact with an obstacle, the document itself is suitably resiliently deformed, enabling the document to be continuously delivered along the obstacle. Thus, as to the space around the apparatus, requirements as strict as those for an apparatus of the document-rack-movable type are not imposed on an apparatus of the roller-delivery type. Accordingly, the apparatus of the roller-delivery type can be used in a relatively narrow space as compared with the apparatus of the document-rack-movable type. Further, even though the apparatus of the roller-delivery type is used in a limited space, neither defective operation nor trouble is anticipated.

In the apparatus of the roller-delivery type, the lower delivery rollers are required to be disposed inside of the main body of the apparatus. However, since the reinforcing frames such as lateral plates, stays and the like are disposed in the main body of the apparatus, the available free space is very small. It is therefore difficult to ensure a space in which the delivery rollers are disposed. When the apparatus body is increased in sizes, the delivery rollers can be readily disposed therein. However, this does not satisfy the demand for a smaller apparatus.

In this connection, it may be proposed to eliminate the reinforcing frames. In this case, however, the main body of the apparatus is reduced in rigidity. This may cause trouble of the influence of an external force upon the functional components, that has not been a problem in a conventional structure. In particular, an image forming apparatus in a compact and lightweight design has been developed based on a concept for spreading such apparatus for family and personal uses. In this connection, the maintenance of apparatus is managed by the user himself or herself, instead of by professional service personnel. However, if the functional components become functionally defective by an external force, the user unfamiliar with technology cannot practically manage such trouble. In this point of view, it is essential in a portable-type image forming apparatus to eliminate the influence of an external force upon the functional components.

To spread the apparatus for family and personal uses, high safety is also required. In particular, provision should be made so as to prevent the user lacking electric knowledge from suffering an accident of electric shock due to his or her careless contact with the wiring or the like in the apparatus, when the main body of the apparatus is opened to cause the inside thereof to be exposed.

Then, it may be proposed to dispose a safety switch adapted to intercept the supply of electric power from the power source line when the main body of the apparatus is opened to cause the inside thereof to be exposed. However, there are instances where the safety switch remains pushed by the hand of the user or the contact of the safety switch is burnt out. In such cases, the accident of electric shock cannot be prevented. Further, when the safety switch is disposed, the number of component elements is increased, resulting in-increased in production cost.

SUMMARY OF THE INVENTION

It is a first object of the present invention to provide an image forming apparatus which requires no reinforcing frames, can be made in a more compact and lightweight design with reduced production cost, can restrain the influence of an external force upon the functional components and is less restricted by a space where the apparatus is installed.

It is a second object of the present invention to provide an image forming apparatus which eliminates the necessity of disposing a safety switch not only involving the likelihood of erroneous operation but also increasing the number of component elements, and in which the connection of the power source line to the functional components and the like can be securely intercepted when the main body of the apparatus is opened to cause the inside to be exposed, thus improving the apparatus in safety.

To achieve the first object, the image forming apparatus in accordance with a preferred embodiment of the present invention comprises functional components respectively forming:

optical means for illuminating a document and for projecting an image corresponding to the document on a photoreceptor;

image forming means for forming an electrostatic latent image on the photoreceptor based on the image projected by the optical means, for converting the electrostatic latent image into a toner image and for transferring the toner image to paper;

paper delivery means including a fixing unit for fixing the toner image transferred to the paper, the paper delivery means being adapted to introduce paper inside of the main body of the apparatus and for discharging the paper from the main body through the image forming means;

drive means for driving the means above-mentioned; and electric components;

the main body made of resin which incorporates the functional components, being formed by separable upper and lower casings each made in a monocoque structure, and the upper casing being provided at the upper part thereof with document delivery means including a pair of delivery rollers for delivering a document along the top surface of the upper casing while the document is held by and between the pair of delivery rollers.

In the image forming apparatus having the arrangement above-mentioned, each of the upper and lower casings is made in a monocoque structure, thus assuring desired rigidity. Further, the functional components are held by the upper and lower casings. Thus, without conventional metallic reinforcing frames disposed, the functional components can be disposed in the casings with the influence of an external force restrained.

The apparatus of the present invention is of the so-called roller-delivery type, and can be consequently reduced in plane area as compared with an apparatus of the document-rack-movable type. Further, since the apparatus incorporates no reinforcing frames, that delivery roller out of a pair of delivery rollers adapted to come in contact with the underside of a document can be disposed inside of the main body of the apparatus, without the main body increased in size. It is therefore possible to adopt the roller-delivery type, yet reducing the apparatus in size. Thus, the apparatus can be used even in a limited space, and even though the apparatus is used in a limited space, there is no possibility of the apparatus operating defectively or causing trouble.

To achieve the second object, the image forming apparatus in accordance with another embodiment of the present invention comprises functional components respectively forming:

optical means for illuminating a document and for projecting an image corresponding to the document on a photoreceptor;

image forming means for forming an electrostatic latent image on the photoreceptor based on the image projected by the optical means, for converting the electrostatic latent image into a toner image and for transferring the toner image to paper;

paper delivery means including a fixing unit for fixing the toner image transferred to the paper, the paper delivery means being adapted to introduce paper into the main body of the apparatus and for discharging the paper from the main body through the image forming means;

drive means for driving the means above-mentioned; and electric components;

the main body made of resin which incorporates the functional components, being formed by separable upper and lower casings each made in a monocoque structure, one of the upper and lower casings being provided with a plug connector to which is connected a plug of a power supply line for supplying electric power to the functional components;

connector means being disposed in the course of a wire which connects the plug connector to the functional components, the connector means being disconnected from each other in association with the operation of separating the upper and lower casings from each other, and to be connected to each other in association with the operation of connecting the upper and lower casings to each other, and the connector means including an upper connector attached to the upper casing, and a lower connector attached to the lower casing and adapted to be connected to the upper connector.

In the image forming apparatus having the arrangement above-mentioned, when the upper and lower casings are separated from each other, the upper connector and the lower connector are automatically separated from each other, thereby to securely disconnect the power supply line from the functional components and the like in the apparatus. Accordingly, without providing of a safety switch which involves the likelihood of erroneous operation, the apparatus can have improved safety at a time when the inside of the apparatus is exposed.

To further achieve the second object, the image forming apparatus in accordance with a further embodiment of the present invention comprises functional components respectively forming:

optical means for illuminating a document and for projecting an image corresponding to the document on a photoreceptor;

image forming means for forming an electrostatic latent image on the photoreceptor based on the image projected by the optical means, for converting the electrostatic latent image into a toner image and for transferring the toner image to paper;

paper delivery means including a fixing unit for fixing the toner image transferred to the paper, the paper delivery means being adapted to introduce paper into the main body of the apparatus and for discharging the paper from the main body through the image forming means;

drive means for driving the means above-mentioned; and electric components;

the main body made of resin which incorporates the functional components, being formed by separable upper and lower casings each made in a monocoque structure, one of the upper and lower casings being provided with a plug connector to which is connected a plug of a power supply line for supplying electric power to the functional components, and the plug as connected to the plug connector being engaged directly or indirectly with the upper and lower casings to prevent the upper and lower casings from being separated from each other, thus forming opening preventive means for preventing the inside of the main body from being exposed in a state where the functional components in the main body are ready for receiving electric power.

In the image forming apparatus having the arrangement above-mentioned, with the plug connected to the plug connector, the opening preventive means prevents the inside of the apparatus from being exposed. More specifically, only in a safe state where the plug is disconnected from the plug connector to interrupt the supply of electric power to the apparatus, the inside of the apparatus can be opened and exposed. Thus, without the necessity of disposing a safety switch which involves the likelihood of erroneous operation, the apparatus have improved safety at a time when the inside of the apparatus is opened and exposed.

DETAILED DESCRIPTION OF THE PREFERRED EMBODIMENTS

Figure 1:
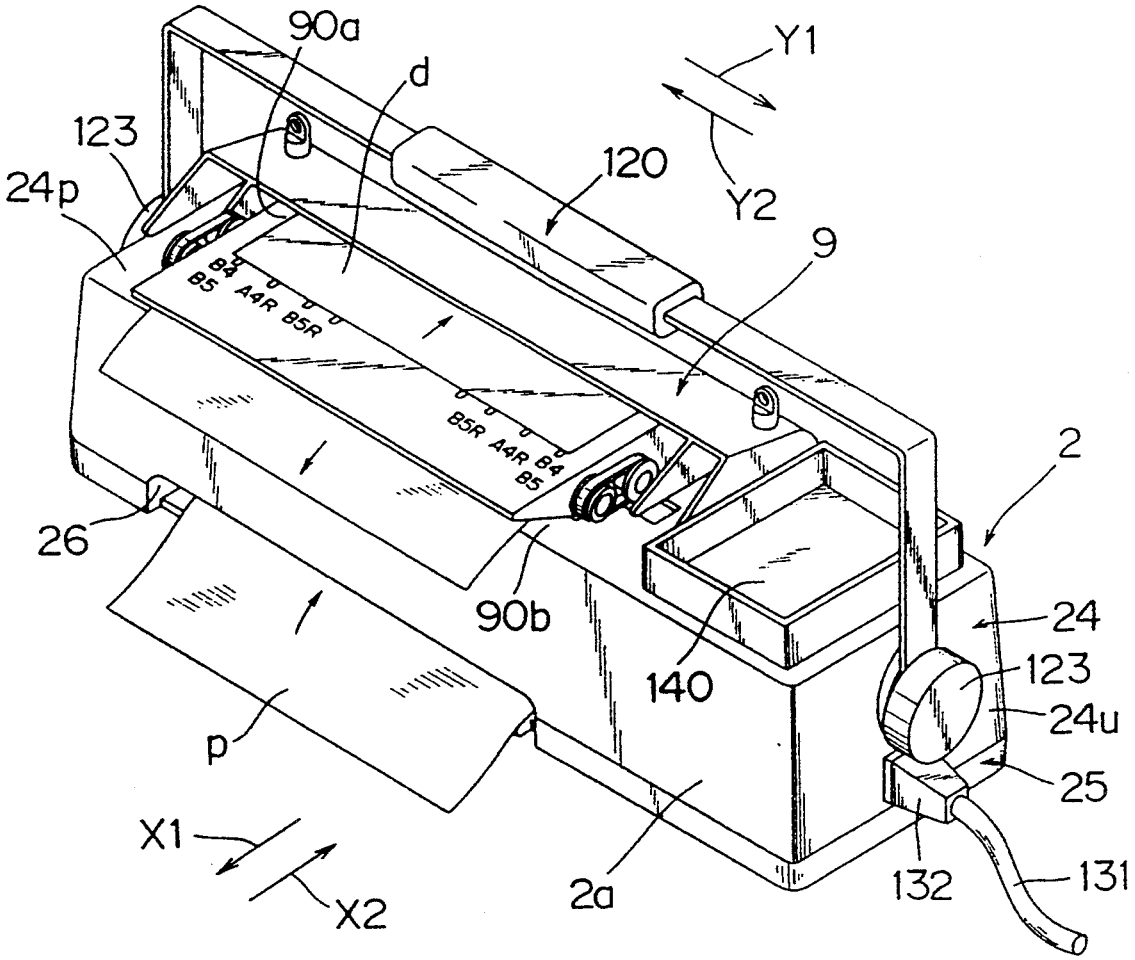
FIG. 1 is a perspective view of an electrophotographic copying apparatus serving as an image forming apparatus in accordance with a first embodiment of the present invention.
Figure 2:
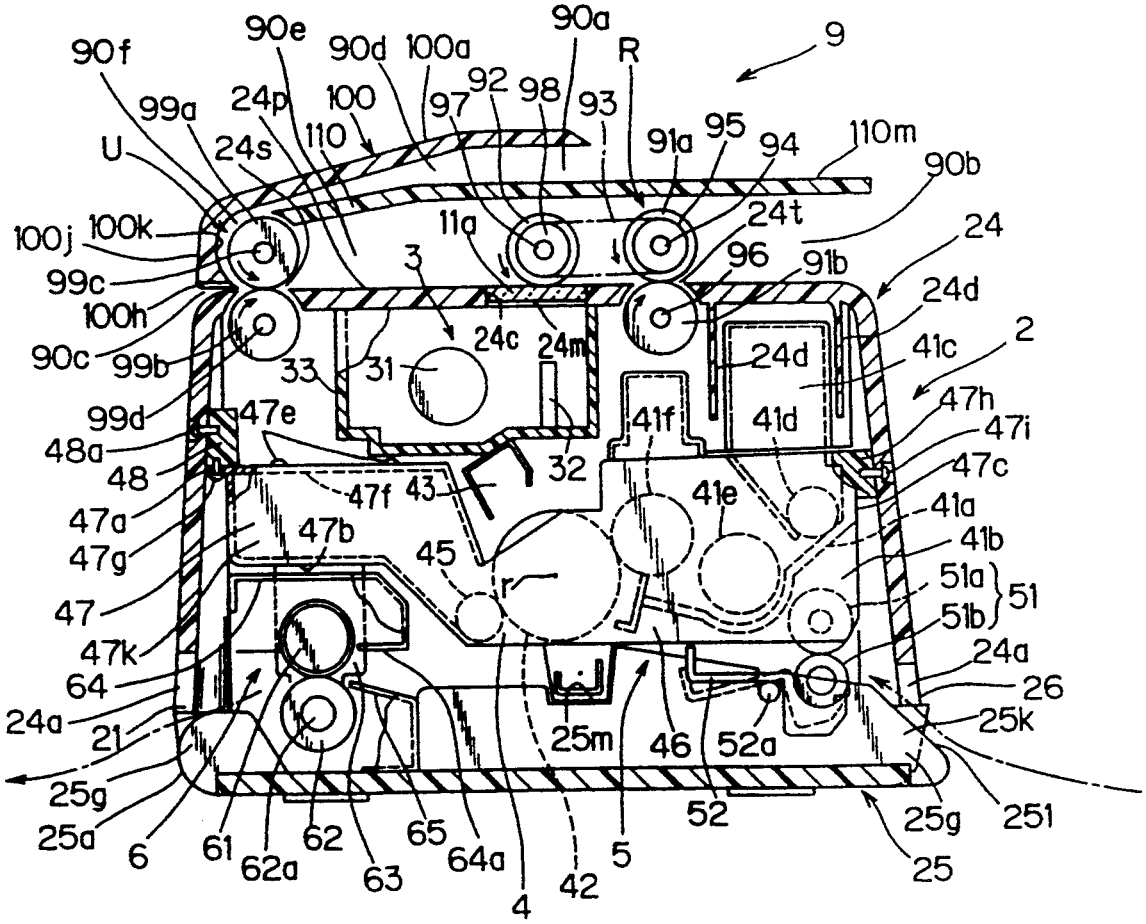
FIG. 2 is a section view of the apparatus shown in FIG. 1.
Figure 3:
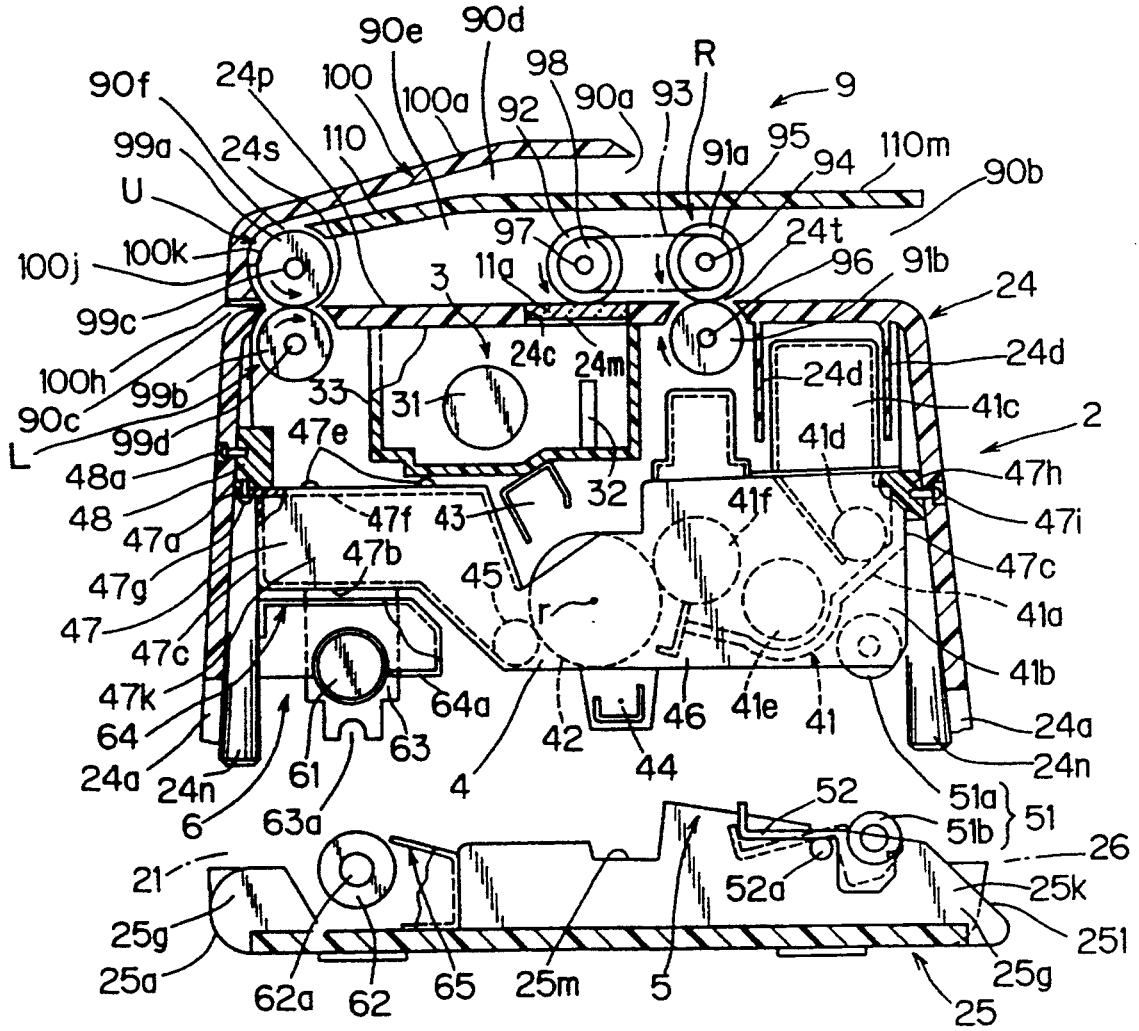
FIG. 3 is an exploded section view of the apparatus shown in FIG. 1.

Referring to FIGS. 1 to 3, an electrophotographic copying apparatus A serving as an image forming apparatus in accordance with a first embodiment of the present invention has a main body 2 formed by an upper casing 24 and a lower casing 25 which are made of resin and which are separably connected to each other by screws. As will be discussed later, the upper casing 24 and the lower casing 25 hold a variety of functional components respectively forming optical means 3, image forming means 4, paper delivery means 5, fixing means 6, drive means 7 (See FIG. 14) and electric components 8 (See FIG. 14) and the like.

Referring to FIG. 1, the upper casing 24 is provided on a top surface 24*p* thereof serving as a document guide with document delivery means 9 for deliverying a document d along the top surface 24*p*.

As shown in FIG. 1, the electrophotographic copying apparatus A is arranged such that a document d inserted from the front side of the main body 2 into a document insertion port 90*a* is inverted at the rear side of the main body 2, delivered along the top surface 24*p*, passed through a document discharge port 90*b* and discharged to the front of the main body 2. A paper feed port 26 for feeding paper p is formed at a lower part of a front surface 2*a* of the main body 2. Provision is made such that paper p fed from the paper feed port 26 is discharged from a paper discharge port 21 (See FIG. 2) at the rear side of the main body 2. Thus, the electrophotographic copying apparatus A is arranged such that a document d and paper p are delivered in the front-to-back direction thereof (In FIG. 1, the forward direction is shown by an arrow X1, while the rearward direction is shown by an arrow X2). The main body 2 is made substantially in the form of a rectangular parallelepiped which is short in the front-to-back direction (X1 to X2) and which is long in the transverse direction (In FIG. 1, the rightward direction is shown by an arrow Y1, while the leftward direction is shown by an arrow Y2).

A small-article container 140 in the form of a rectangular parallelepiped of which top side is opened, is removably attached to the top surface 24*p*. A U-shape carrying handle 120 is formed as if both end surfaces 24*u* of the upper casing 24 are held by and between the ends of the U-shape handle 120. Both end portions 122*b* of a frame 122 forming a part of the handle 120 are rotatably attached by fitting members 123 serving as shaft members for connecting the upper casing 24 and the lower casing 25 to each other. Thus, the handle 120 is rotatable in a predetermined range around the fitting members 123. A plug 132 at the tip of a power supply line 131 for supplying an electric power is inserted inside of the main body 2 from one of the end surfaces 24*u* of the upper casing 24.

Inside Arrangement of the Electrophotographic Copying Apparatus

Referring to FIGS. 2 and 3, the main body 2 incorporates the functional components such as the optical means 3, the image forming means 4, the paper delivery means 5, the fixing means 6, the drive means 7, the electric components and the like.

The optical means 3 is adapted to illuminate and scan a document d, and to guide light reflected from the document d to a photosensitive drum 42 of the image forming means 4. The optical means 3 is formed by functional components such as a rod-like fluorescent lamp 31 for illuminating a document d, a lens 32 for guiding light reflected from the document d to the photosensitive drum 42, and the like which are housed in a case 33.

The image forming means 4 is so arranged as to form an electrostatic latent image corresponding to a document image formed by light reflected from the document d, to convert the electrostatic latent image into a toner image and to transfer the toner image to paper p. The image forming means 4 is formed by functional components such as the photosensitive drum 42 for forming and carrying an electrostaic latent image corresponding to a document image, a charging corona discharger 43, a developing device 41, a transferring corona discharger 44, a cleaner 45 and the like, the members 43, 41, 44, 45 being successively disposed around the photosensitive drum 42. The image forming means 4 has a structure known per se arranged such that an electrostatic latent image corresponding to a document image is formed on the outer peripheral surface of the photosensitive drum 42 uniformly electrically charged by the charging corona discharger 43, the electrostatic latent image is converted into a toner image by the developing device 41, the toner image is transferred to paper p by the transferring corona discharger 44 and residual toner is collected by the cleaner 45.

Figure 6:
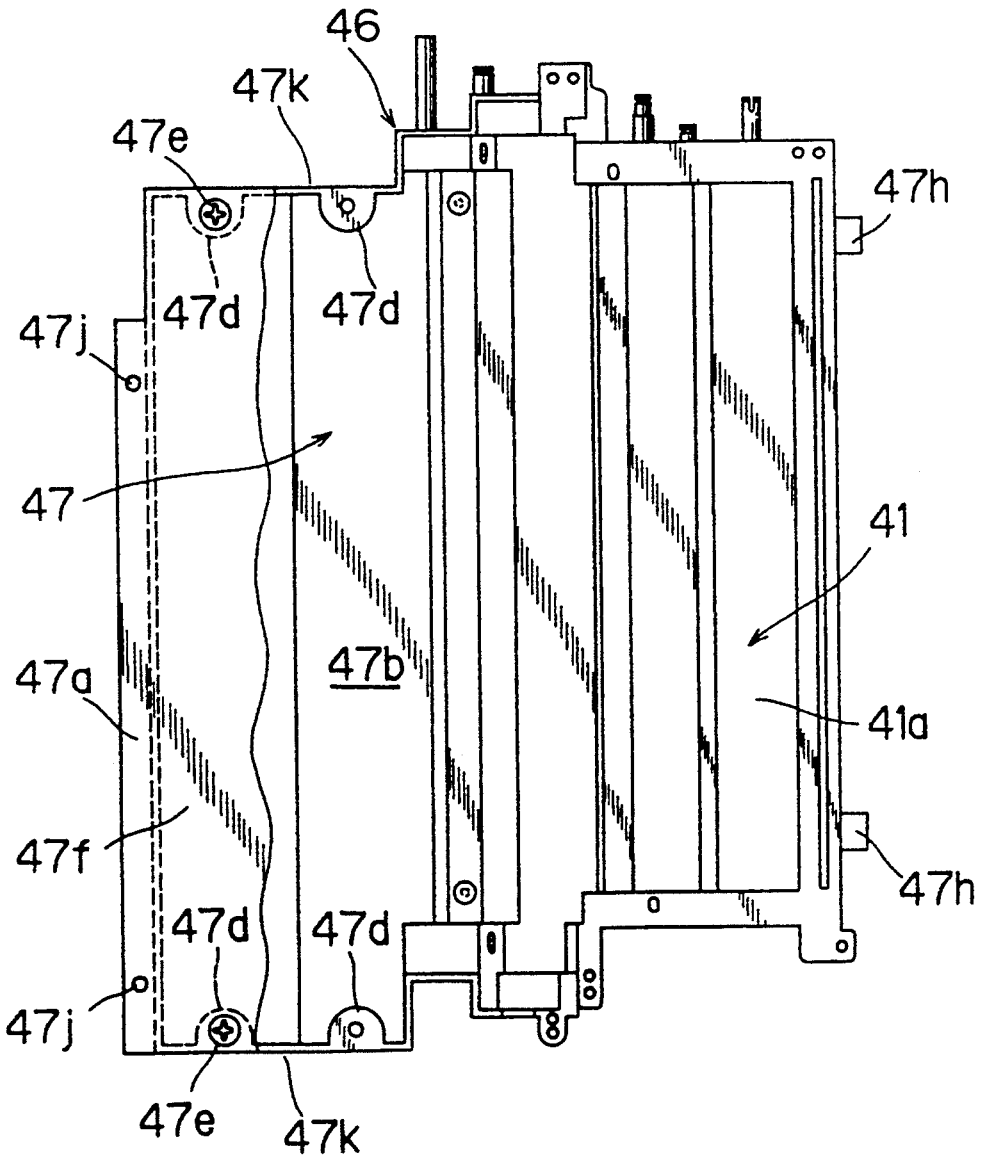
FIG. 6 is a plan view of an image forming frame and a toner collecting container of the apparatus shown in FIG. 1.

As the component elements of the image forming means 4, the developing device 41, the photosensitive drum 42, the transferring corona discharger 44 and the cleaner 45 are unified as assembled with an image forming frame 46 (See FIG. 6). The charging corona discharger 43 is held by the case 33 of the optical means 3. The image forming frame 46 is formed by a resin molded body. A toner collecting container 47 and a developing housing 41*a* of the developing device 41 are integrally molded with the image forming frame 46.

Referring to FIGS. 2 and 6, the toner collecting container 47 is made in the form of a tray rectangular in plan elevation and disposed above the downstream side of the paper delivery direction of the paper delivery means 5. A lid 47*f* covers the top of the toner collecting container 47. The toner collecting container 47 is provided at the inner periphery of a lateral wall 47*k* thereof with a plurality of vertically extending ribs 47*d*. The lid 47*f* is attached to the toner collecting container 47 by screwing screws 47*e* into holes in the ribs 47*d*. A flange 47*a* is formed as extending from the lid 47*f* of the toner collecting container 47 in the leftward direction in FIG. 6.

The developing device 41 comprises a toner cartridge 41*c* removably attached to the developing housing 41*a* made of resin, a toner feed roller 41*d* for feeding toner falling from the toner cartridge 41*c* to the inside of the developing housing 41*a*, a stirring roller 41*e* for stirring toner fed into the developing housing 41*a*, and a developing roller 41*f* for feeding toner to the photosensitive drum 42. A plurality of rib-like upper guides 41*b* parallel to one another are projectingly disposed at the underside of the developing housing 41*a* and adapted to guide the top surface of paper p to be delivered. The upper guides 41*b* are formed integrally with the developing housing 41*a*. This reduces the number of component elements and the number of assembling steps, resulting in reduction in production cost, as compared with the arrangement in which the upper guides are independently formed.

The paper delivery means 5 comprises (i) a pair of an upper roller 51*a* and a lower roller 51*b* for deliverying paper p which is introduced inside of the main body 2 with the paper tip held between and by the rollers 51*a*, 51*b*, (ii) a regist stopper 52 adapted to temporarily stop the paper p when the tip of the paper p delivered by the rollers 51*a*, 51*b* comes in contact with the regist stopper 52, and (iii) the fixing means 6.

The upper roller 51*a* is rotatably supported by the upper guides 41*b* projectingly disposed at the developing housing 41*a* of the developing device 41. More specifically, the upper guides 41*b* also serve as members for supporting the upper roller 51*a*.

The fixing means 6 is adapted to fix a toner image transferred to paper p while delivering the paper p as held by the image fixing means 6, and comprises a heat roller 61 heated by an incorporated heater, and a pressure roller 62 adapted to be rotated following the rotation of the heat roller 61 while the pressure roller 62 is pressingly contacted therewith. While normally biased upwardly by spring means (not shown), the pressure roller 62 is movable in the vertical and transverse directions thereof. By introducing a support shaft 62*a* of the pressure roller 62 into a groove portion 63*a* in a stay 63 for supporting the heat roller 61, the heat roller 61 and the pressure roller 62 are relatively positioned with respect to each other. The circumference of the heat roller 61 is substantially covered with a housing 64 fixed by the stay 63, thus restraining heat radiation. The housing 64 is provided at the lower end thereof with a guide portion 64*a* for guiding paper p to the heat roller 61 together with lower guides 65.

The regist stopper 52 is rotatable around a support 52*a*. By coil spring means (not shown), the regist stopper 52 is so biased as to be normally rotated clockwise in FIG. 2 and projects into the delivery passage of paper p. In this projecting state, the regist stopper 52 comes in contact with the tip of paper p, causing the paper p to be temporarily stopped. When a document d is moved to a predetermined position, the regist stopper 52 is adapted to be rotated counter-clockwise and retreated from the paper delivery passage by a rotating mechanism (not shown) interlocked with delivery rollers 91*a*, 91*b* or the like. This enables the paper p temporarily stopped to be fed to the image forming means 4.

The drive means 7 is disposed to drive the photosensitive drum 42, the toner feed roller 41*d*, the stirring roller 41*e* and the developing roller 41*f* of the developing device 41, the upper roller 51*a* of the paper delivery means 5, the heat roller 61 of the fixing means 6 and roller means R, to be discussed later, of the document delivery means 9. The drive means 7 is formed by functional components such as a power source or motor 71, a gear mechanism 72 for transmitting the power of the motor 71, and the like.

The electric components 8 comprise a control board 8*a* for controlling a variety of drives made by the drive means 7, electric parts such as transformers and the like (not shown), wires and the like.

Figure 14:
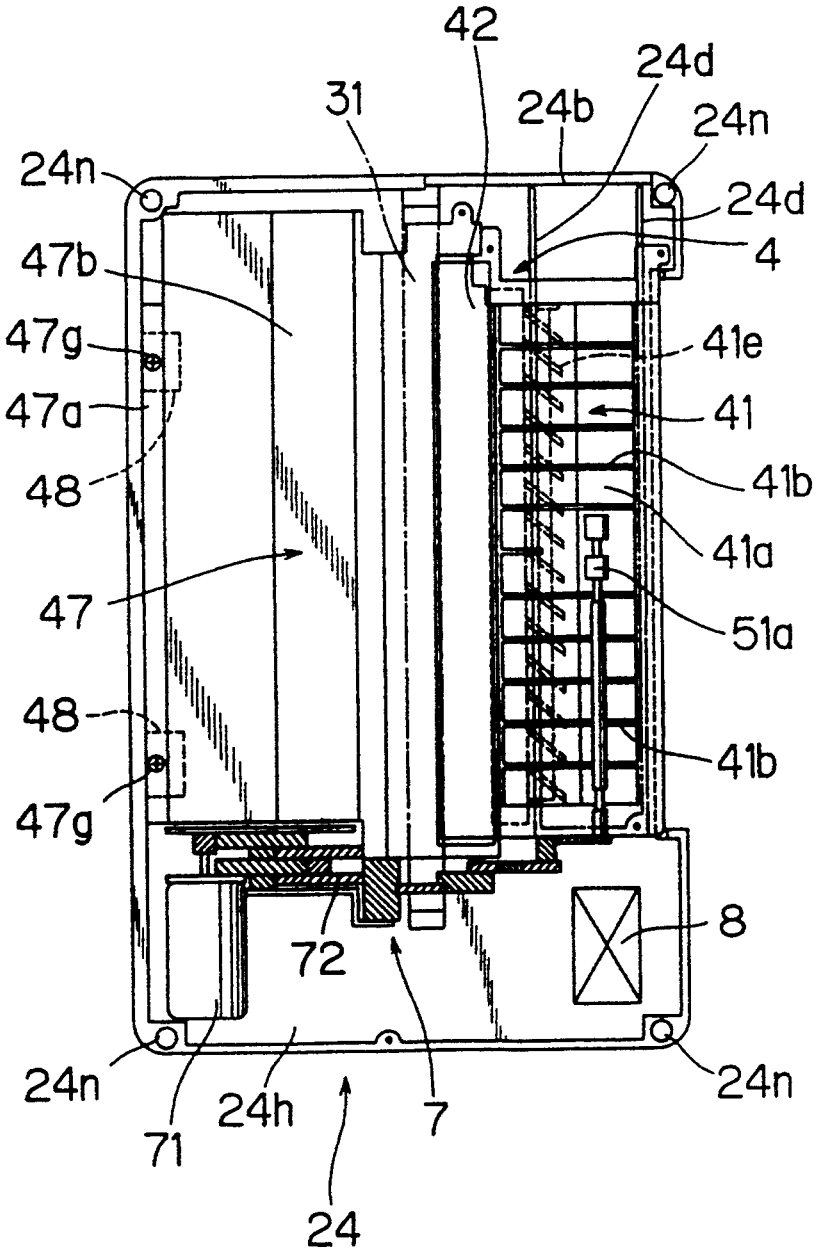
FIG. 14 is a bottom view of the upper casing, illustrating how functional components are held by the upper casing.

As shown in FIG. 14, the functional components forming the drive means 7 are secured to a station 24*h* formed inside of the upper casing 24. The control board 8*a* of the electric components 8 is also secured to the station 24*h*. All the elements of the electric components 8 are attached to the upper casing 24. Thus, the drive means 7 and the electric components 8 are collectively disposed at the side of the upper casing 24. This efficiently facilitates the wiring for the drive means 7, as well as the wiring among the electric components. When the drive means 7 and the electric components 8 are respectively disposed at the upper casing 24 side and at the lower casing 25 side, it is required to electrically connect the upper casing 24 to the lower casing 25. Further, since the wiring cannot be collectively made, the wiring takes much labor. In the embodiment where the drive means 7 and the electric components 8 are collectively disposed at the upper casing 24 side, it is not required to electrically connect the upper casing 24 to the lower casing 25 and the wiring can be collectively made at one casing side. This efficiently facilitates the wiring, thus reducing the production cost.

Holding Functional Components by the Casings

As discussed in the foregoing, the main body 2 is formed by the upper casing 24 and the lower casing 25 which are separable from each other, and the optical means 3, the image forming means 4, the paper delivery means 5, the drive means 7 and the electric components 8 which serve as the functional components, are held by the upper casing 24 and the lower casing 25.

Figure 4:
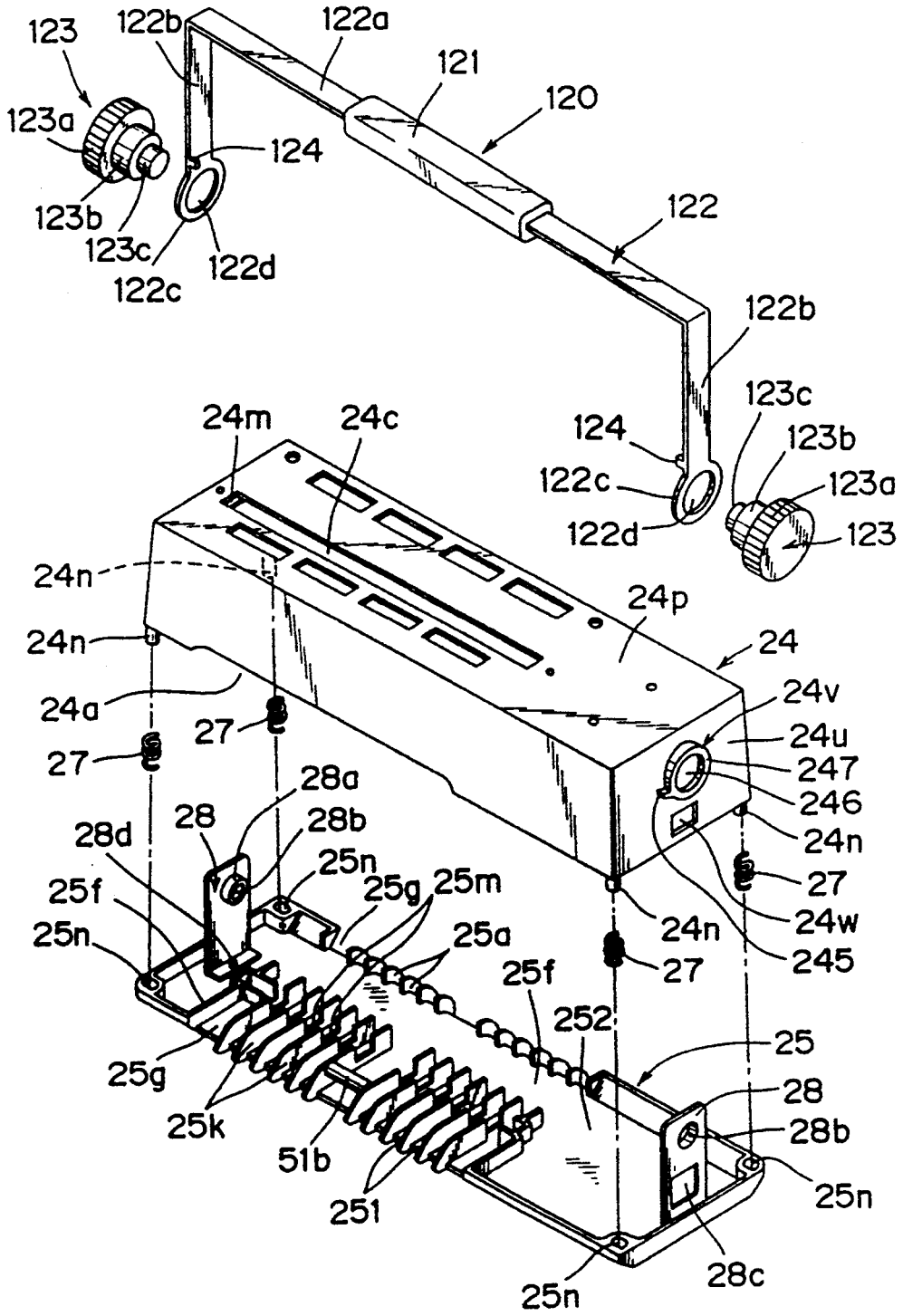
FIG. 4 is an exploded perspective view of an upper casing, a lower casing and a handle of the apparatus shown in FIG. 1.

Referring to FIGS. 2, 4 and 14, the case 33 of the optical means 3 is attached to the upper casing 24 by screws, so that the entire optical means 3 is held by the upper casing 24.

The image forming frame 46 of the image forming means 4 is attached to the upper casing 24 by screws. In FIG. 2, the left end of the image forming frame 46 is secured, by screws 47*g*, to attaching members 48 secured to the upper casing 24 by screws 48*a*, and attaching portions 47*h* at the right end of the image forming frame 46 are secured to the upper casing 24 by screws 47*i*. Out of the image forming means 4, the developing device 41, the photosensitive drum 42, the transferring corona discharger 44 and the cleaner 45 are held by the upper casing 24. The remaining element of the image forming means 4, i.e., the charging corona discharger 43 is indirectly held by the upper casing 24 through the case 33 of the optical means 3.

In the paper delivery means 5, the upper roller 51*a* out of the pair of delivery rollers 51 is indirectly held by the upper casing 24 through the developing housing 41*a*, and the lower roller 51*b* and the regist stopper 52 are held by lower guides 25*a*, to be discussed later, which are formed integrally with the lower casing 25. In the image fixing means 6, the heat roller 61 and the housing 64 are held by the upper casing 24 through the stay 63, while the pressure roller 62 and the lower guides 65 are held by the lower casing 25.

As thus discussed, the functional components are held by the casings 24, 25 each made in a monocoque structure which assures rigidity, so that the influence upon the functional components by an external force exerted on the main body 2 can be restrained. In particular, the important functional components such as the image forming means 4 and the like can be attached to the casings 24, 25 without these functional components substantially changed in form. Accordingly, the original rigidity inherent in each functional component itself can also be sufficiently assured. As a result, the apparatus of the present invention can securely stand an excessive external force. Accordingly, the apparatus of the present invention can exhibit excellent durability even if the user handles it rudely.

Since the apparatus of the present invention is of the so-called roller-delivery type, the main body can be reduced in plane area as compared with an apparatus of the document-rack-movable type. Since no reinforcing frames are incorporated in the main body 2, lower delivery rollers 91*a*, 91*b* (See FIG. 2) of the roller means R, to be discussed later, of the document delivery means 9 can be disposed inside of the main body 2 without the main body 2 made in a large-sized design. In other words, the roller delivery system can be adopted while making the apparatus in a compact design. Thus, the apparatus of the present invention can be used in a narrow space, and even though the present apparatus is used in a narrow space, there is no possibility of defective operation, trouble and the like.

Handle

Referring to FIGS. 1 and 4, the handle 120 comprises a carrying portion 121 made of resin or the like and the frame 122 made of substantially U-shape metal or the like having the carrying portion 121 at the longitudinal center thereof. The frame 122 has (i) a main portion 122*a* which extends in the longitudinal direction of the main body 2 when the frame 122 is attached to the main body 2, and (ii) extending portions 122*b* which are bent from both ends of the main portion 122*a* at right angles thereto and which extend along the end surfaces 24*u* of the upper casing 24. The extending portions 122*b* are provided at the tips thereof with ring portions 122*c* having holes 122*d* through which are passed the fitting members 123 serving as shaft members for connecting the upper casing 24 and the lower casing 25 to each other. The fitting members 123 have (i) grip portions 123*a* which can be rotated by the hand, (ii) support portions 123*b* which are fittingly inserted into the holes 122*d* in the handle 120 and which rotatably support the handle 120, and (iii) screw portions 123*c* for attaching the handle 120 to attaching members 28 to be discussed later. Provision is made such that the fitting members 123 can be externally readily attached to and removed from the attaching members 28 by rotating the fitting members 123 by the hand. Accordingly, the user can readily attach and remove the handle 120 without use of a tool such as a screwdriver or the like. The user who does not require the handle 120, can conveniently use the apparatus with the handle 120 removed therefrom.

The handle 120 supports the main body 2 made substantially in the form of a rectangular parallelepiped at its both ends in the longitudinal direction thereof. This reduces the moment of inertia of the main body 2 which is swung around the fitting members 123 when the apparatus is carried with the handle 120 held. Accordingly, the main body 2 hardly swings and is easy to carry. Since the main body 2 hardly swings, there is no possibility of the apparatus striking against obstacles. Further, since the electrophotographic copying apparatus A is of the roller-delivery type, the length of the document delivery means 9 in the document delivery direction is shorter than the length thereof in the direction at a right angle to the document delivery direction. It is therefore possible to make the main body 2 substantially in the form of a rectangular parallelepiped as mentioned earlier. Provision is made such that, when the apparatus is lifted up with the handle 120 held, the carrying portion 121 is located in a position which lies on a perpendicular line passing through the center of gravity of the main body 2 and which is above the center of gravity of the main body 2. Accordingly, the main body 2 placed on a desk or the like, can be held up as it is without being rotated. Since the carrying portion 121 of the handle 120 is positioned at the longitudinal center portion of the handle 120, the main body 2 can be stably lifted up with the handle 120 held.

Figure 12:
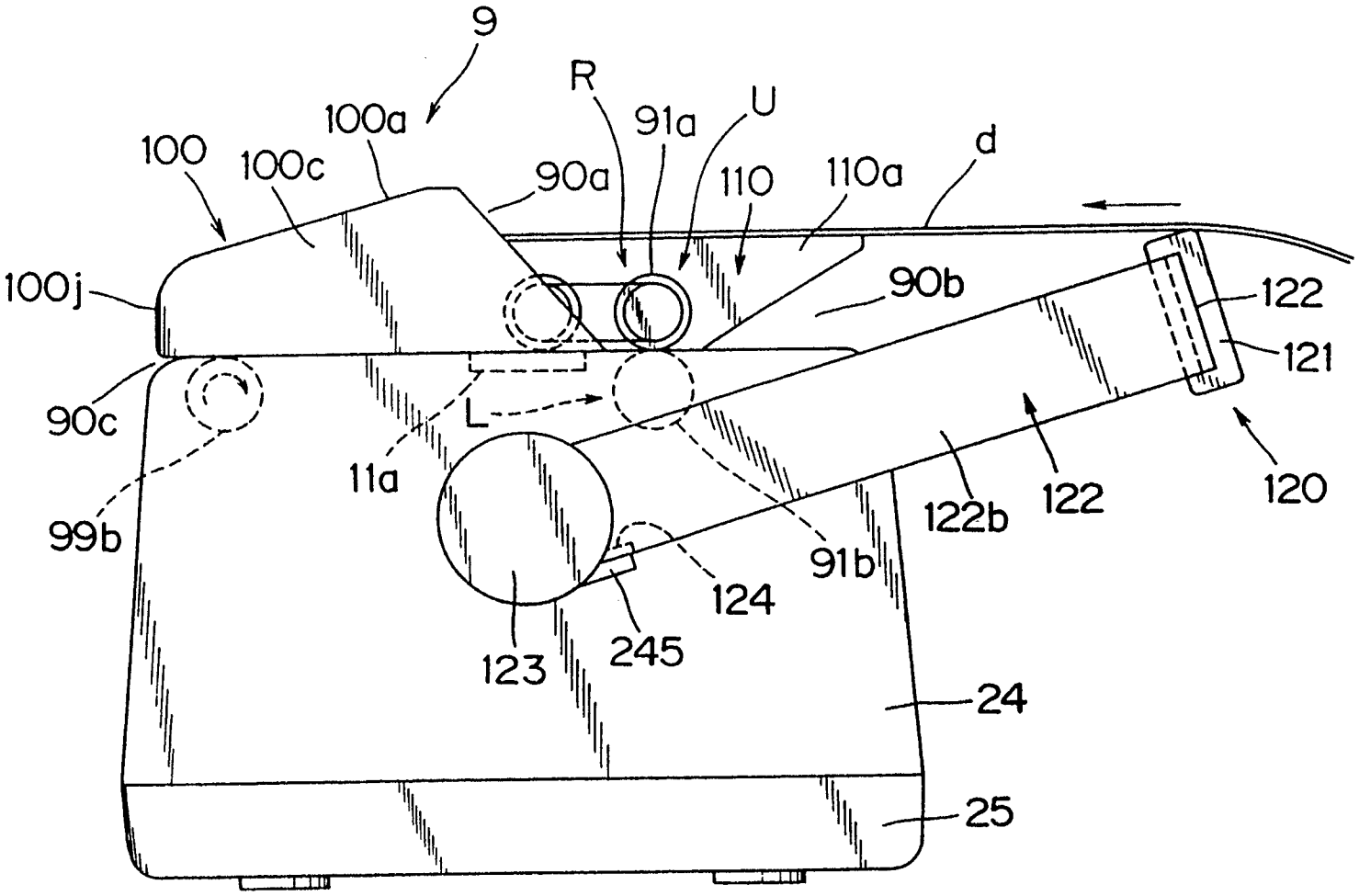
FIG. 12 is a side view of the apparatus shown in FIG. 1, illustrating how a document is introduced therein.
Figure 13:
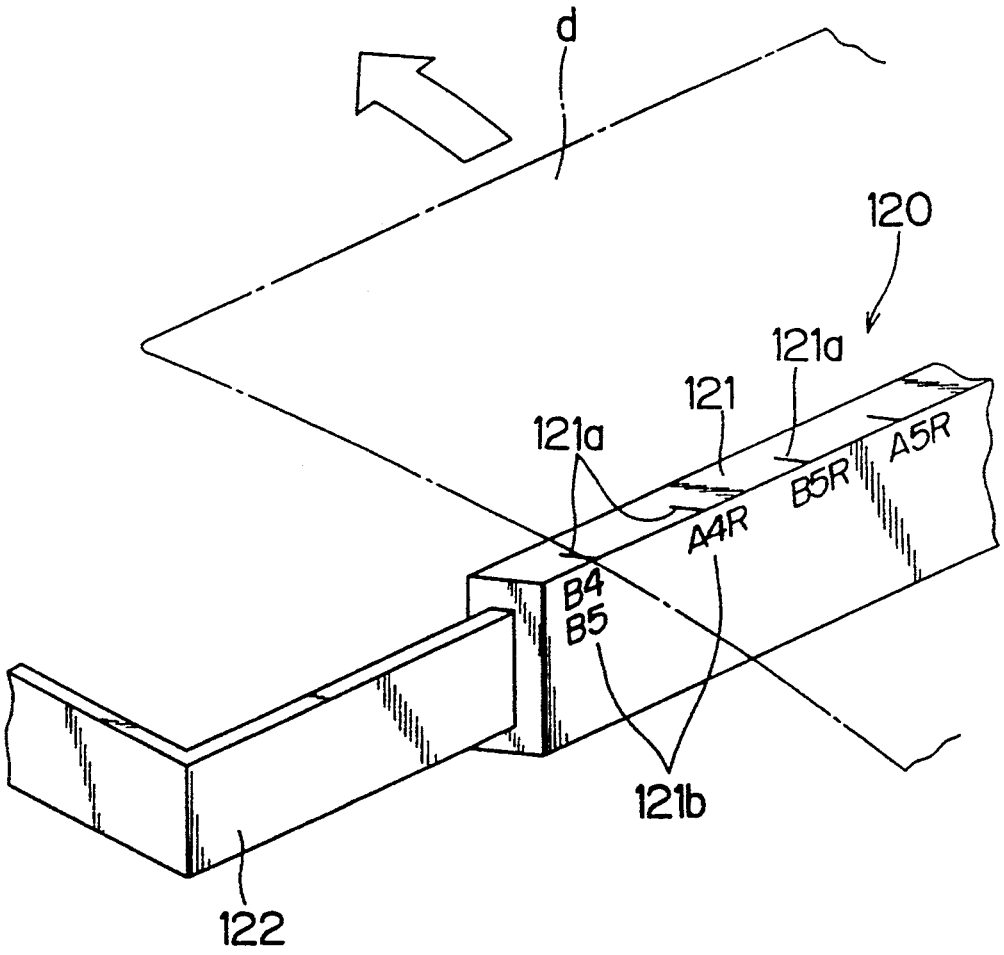
FIG. 13 is an enlarged perspective view of main portions of the handle.

In the vicinity of the ring portions 122*c* of the extending portions 122*b* of the frame 122, there are formed projecting pieces 124 engaged with stoppers 245 serving as regulating means which are formed integrally with cylindrical receiving seats 24*v*, to be discussed later, of the upper casing 24. When the projecting pieces 124 are engaged with the stopper 245, the handle 120 is positioned at a predetermined rotation position at the front side of the electrophotographic copying apparatus A (See FIG. 12). At this position, the carrying portion 121 and the main portion 122*a* of the frame 122 are set to such proper heights as to aid the delivery of a document. Referring to FIG. 13, there are put, on the handle 120, marks 121*a* such as lines or the like and displays 121*b* representing document sizes corresponding to the marks 121*a*. These marks 121*a* and displays 121*b* show document setting positions according to document sizes and are put at such positions that the user can conveniently see when the handle 120 is thrown down to the front side of the electrophotographic copying apparatus A and held by the stoppers 245.

As discussed in the foregoing, when the rotation of the handle 120 is regulated to a predetermined level by the stoppers 245, the handle 120 supports the rear end of a document d delivered by the document delivery means 9, assuring stable delivery of the document d. Further, it is not necessary to independently dispose a tray for guiding a document, thereby reducing the number of the component parts. Accordingly, the apparatus can be made in a compact design and at a reduced production cost. A document can be positioned by the marks 121*a* put on the carrying portion 121 of the handle 120, thus preventing the document from being obliquely delivered. This assures a more stable delivery. Further, a lower cover 110 is also provided with positioning projections 110*j*. Thus, a document d can be positioned with the joint use of the projections 110*j* and the marks 121*a*. This assures more accurate positioning.

To set the handle 120 to the predetermined rotation position above-mentioned, there may be used, instead of the stoppers 245 and the like, a frictional force between the ring portions 122*c* and the end surfaces 123*d* of the grip portions 123*a*, or a frictional force between the ring portions 122*c* and the seat surfaces 247 of the cylindrical receiving seats 24*v* to be discussed later (See FIG. 9).

Immediately below the fitting members 123 around which the handle 120 is to be rotated, the plug 132 of the power supply line 131 is disposed, so that the power supply line 131 or the plug 132 does not prevent the handle 120 from being smoothly rotated.

Lower Casing

Referring to FIGS. 3 and 4, the lower casing 25 is formed by a resin molded body and made in the form of a shallow container of which the top side is opened. The lower casing 25 is provided on an inner bottom 252 with a plurality of rib-like lower guides 25*a*, 25*k* for guiding the underside of paper delivered, these lower guides 25*a*, 25*k* being formed integrally with the inner bottom 252. The lower guides 25*k* are provided at the ends thereof with inclined portions 251 which are increased in height along the paper delivery direction. The inclined portions 251 are disposed for facilitating the introduction of paper placed on a desk or the like into the paper feed port 26.

Referring to FIGS. 1 and 2, since the paper feed port 26 is formed at the lower part of the main body 2 and the inclined portions 251 are disposed, paper p placed on a desk or the like can be smoothly introduced while utilizing the desk surface as a guide for delivering the paper p, without use of a paper feed tray or the like. Thus, the paper feed tray which is liable to be broken or lost, need not be utilized, enabling a reduction in the number of component parts. Accordingly, the electrophotographic copying apparatus A can be made in a compact and lightweight design and with a reduced production cost. Further, there is no need for a space for storing the paper feed tray.

The lower guides 25*k* are provided with concave portions 25*m* to which attached is the transferring corona discharger 44 which is one of the component elements of the image forming means 4. The lower casing 25 is provided with rib-like raised pieces 25*f* which extend to both ends of the transferring corona discharger 44, the raised pieces 25*f* being continuously formed at the peripheral side wall of the lower casing 25. By the raised pieces 25*f*, the lower guides 25*a*, 25*k* and the like, the lower casing 25 is made in a monocoque structure to assure a desired rigidity. The lower guides 25*a*, 25*k* for guiding the delivery of the underside of paper are formed integrally with the lower casing 25 as mentioned earlier. It is therefore not required to independently form such lower guides, thus reducing the number of component elements. Further, it is not necessary to assemble the lower guides, thus reducing the production cost.

A pair of substantially L-shape attaching members 28 are attached, by screws 28*d*, to both longitudinal ends of the inner bottom 252 of the lower casing 25. The attaching members 28 are disposed for attaching the fitting members 123 serving as the shaft members for positioning the casings 24, 25 in the vertical direction. Projections 28*a* are formed on the attaching members 28 at the opposite surfaces thereof. The projections 28*a* have screw holes 28*b* which pass through the projections 28*a* in the longitudinal direction thereof. One of the attaching members 28 has a window 28*c* through which the plug 132 is passed.

Upper Casing

Figure 5:
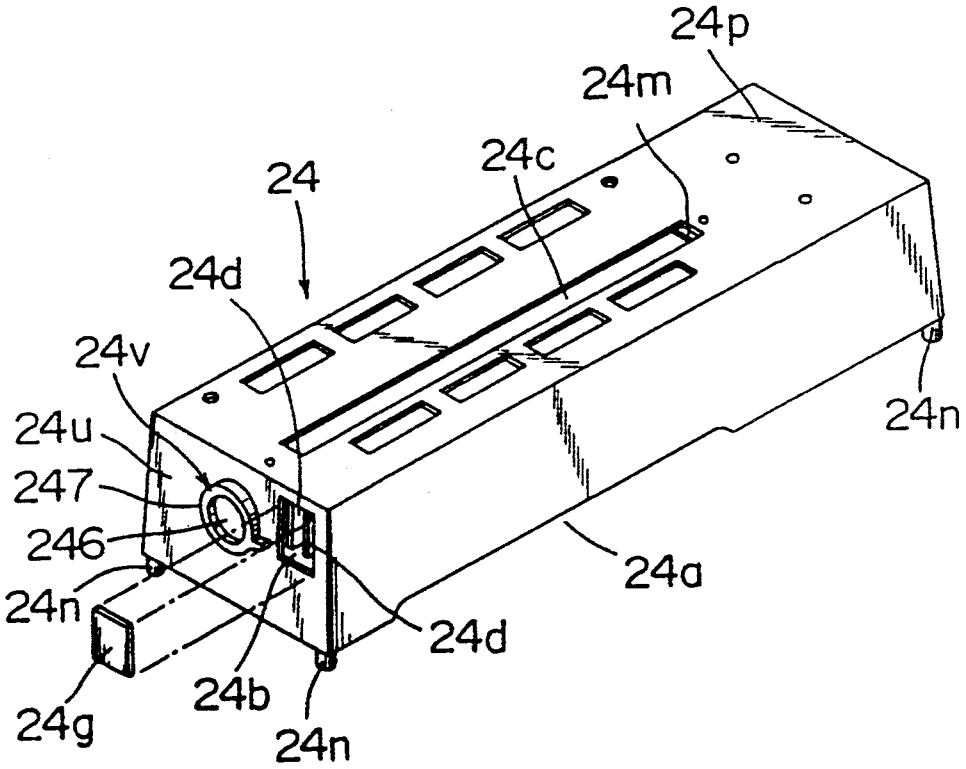
FIG. 5 is an exploded perspective view of the upper casing shown in FIG. 4.

Referring to FIGS. 4 and 5, the upper casing 24 is formed by a resin molded body in a unitary structure. The upper casing 24 is provided in the front and rear surfaces thereof with notches 24*a* which form the paper feed port 26 and the paper discharge port 21, respectively. One of the end surfaces 24*u* of the upper casing 24 has an opening 24*b* through which the toner cartridge 41*c*, to be discussed later, is inserted and removed. On the end surfaces 24*u* of the upper casing 24, the cylindrical receiving seats 24*v* are projectingly formed around through-holes 246 into which the fitting members 123 are inserted. One of the end surfaces 24*u* has a window 24*w* through which the plug 132 of the power supply line 131 is inserted.

The top surface 24*p* has a slit 24*c* to be used for illuminating and scanning a document. A transparent platen 11*a* is supported by projecting edges 24*m* formed at both end portions of the slit 24*c*. Further, the top surface 24*p* has holes and the like used for attaching the component elements of the document delivery means 9 and the small-article container 140.

The upper casing 24 is provided inside thereof with a pair of band-like guides 24*d* for guiding the introduction of the toner cartridge 41*c*, the guides 24*d* being suspended. The guides 24*d* are simultaneously formed integrally with the upper casing 24 and extend substantially throughout the length of the toner cartridge 41*c* (See FIG. 14).

The toner cartridge 41*c* can be inserted and removed through the opening 24*b* by removing a cover 24*g* which covers the opening 24*b* of the upper casing 24. Thus, the toner cartridge 41*c* can be readily exchanged without the inside of the main body 2 opened. Further, since the guides 24*d* for guiding the insertion and removal of the toner cartridge 41*c* are formed integrally with the upper casing 24, it is not required to independently form such guides. This not only reduces the number of component elements and the number of assembling steps, but also reduces the production cost. The upper casing 24 is made in a monocoque structure by the guides 24*d* and the like, thus assuring a desired rigidity.

Relative Positioning of Both Casings

The following description will discuss how the upper casing 24 and the lower casing 25 are positioned.

Figure 7:
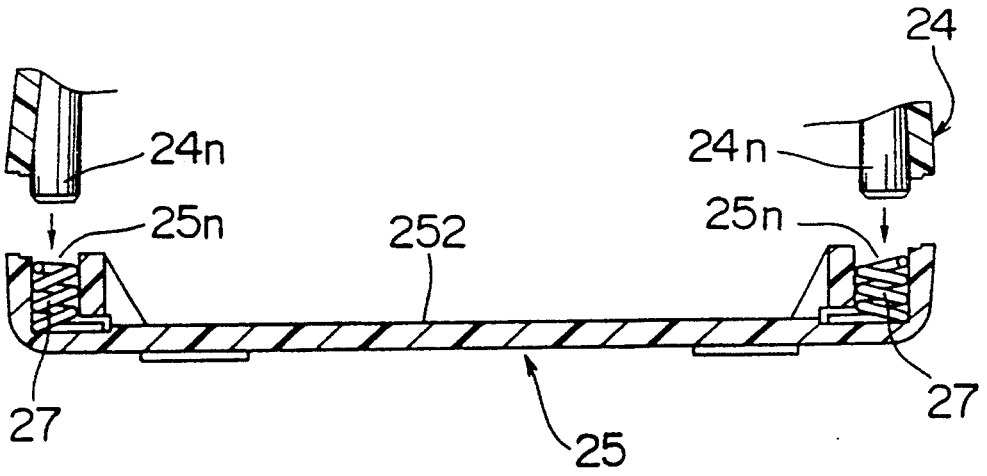
FIG. 7 is a schematic vertical section view of portions of the upper casing and portions of the lower casing, both portions being adapted to be connected to each other.
Figure 8:
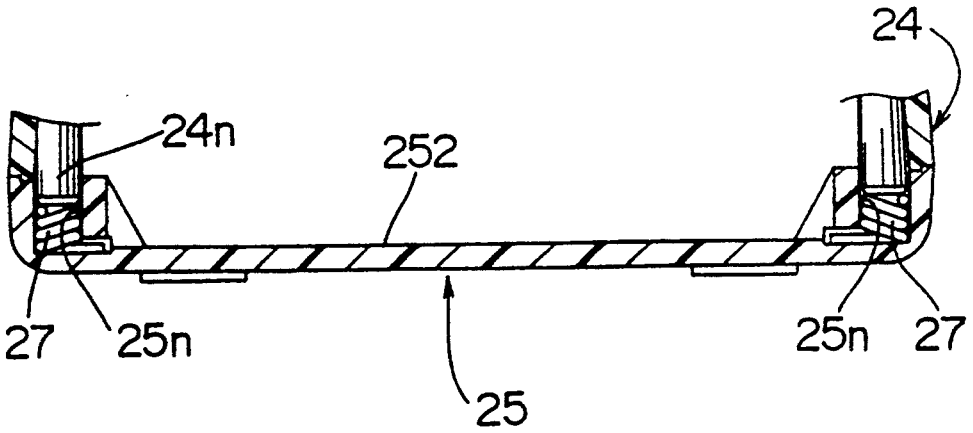
FIG. 8 is a schematic section view of those portions of the upper casing and lower casing which are connected to each other.

Positioning the casings 24, 25 in the front-to-back and transverse directions is made with the use of downwardly extending boss portions 24*n* formed at the four corners of the upper casing 24, and concave portions 25*n* which are formed in the lower casing 25 and which are fitted to the boss portions 24*n*. With reference to FIG. 7, helical compression springs 27 serving as resilient members are disposed in the concave portions 25*n*. The helical compression springs 27 are disposed between the lower end surfaces of the boss portions 24*n* and the bottom surfaces of the concave portions 25*n* for biasing the boss portions 24*n* in the disengaging direction (upward direction) (See FIG. 8).

By bringing the upper casing 24 (which is separated from the lower casing 25) close to the lower casing 25 as shown in FIG. 7 and by fitting the boss portions 24*n* of the upper casing 24 into the concave portions 25*n* of the lower casing 25, both casings 24, 25 can be readily positioned in the front-to-back direction and the transverse direction. When the fitting members 123 are removed, the upper casing 24 is lifted up by the helical compression springs 27 so that the casings 24, 25 can be readily separated from each other.

On the other hand, positioning the casings 24, 25 in the vertical direction is made with the use of the fitting members 123 serving as the shaft members. Referring to FIG. 9 showing how both casings 24, 25 are attached to each other, the fitting members 123 as fittingly inserted into the through-holes 246 in the upper casing 24 are secured to the attaching members 28 of the lower casing 25, thus regulating the relative movement of the upper casing 24 and the lower casing 25 in the vertical direction.

Thus, by attaching the fitting members 123 to the attaching members 28, the both casings 24, 25 can be readily positioned in the vertical direction. Further, since the fitting members 123 are threadedly connected to the attaching members 28, positioning the casings 24, 25 in the vertical direction can be securely made. By merely removing the fitting members 123, the casings 24, 25 can be separated from each other. It is therefore very easy to disassemble and assemble the main body 2. This considerably facilitates maintenance of the apparatus as compared with a structure to be disassembled and assembled by loosening and fastening a number of screws and the like with the use of screwdrivers. In addition, the fitting members 123 can be rotated at the grip portions 123*a* by hand. This further facilitates the disassembling and assembling as compared with the structure to be disassembled and assembled by rotating screws and the like with screwdrivers.

With the fitting members 123 secured to the attaching members 28, the ring portions 122*c* at both ends of the handle 120 are slidably held by and between the end surfaces 123*d* of the screw portions 123*c* of the grip portions 123*a* and the seat surfaces 247 of the cylindrical receiving seats 24*v*. Accordingly, the handle 120 is rotatably supported by the fitting members 123. Thus, the fitting members 123 serving as the members for positioning the casings 24, 25 in the vertical direction, also serve as the fulcra around which the handle 120 is rotated. This reduces the number of component elements, resulting in reduction in the production cost.

A hanging piece 23*a* is hung down from the inner upper surface 248 of the upper casing 24. A downwardly extending stay 23*b* having an L-shape section is attached to the lower end of the hanging piece 23*a* by a screw 23*c*. A plug connector 23*d* connected to a power transformer or the like is attached to the stay 23*b*. The plug 132 is passed through the window 24*w* in one of the end surfaces 24*u* of the upper casing 24 and the window 28*c* in one of the attaching members 28, and is connected to the plug connector 23*d*. The plug 132 as connected to the plug connector 23*d*, is engaged directly with the upper casing 24 and indirectly with the lower casing 25 through one of the attaching members 28.

Figure 10:
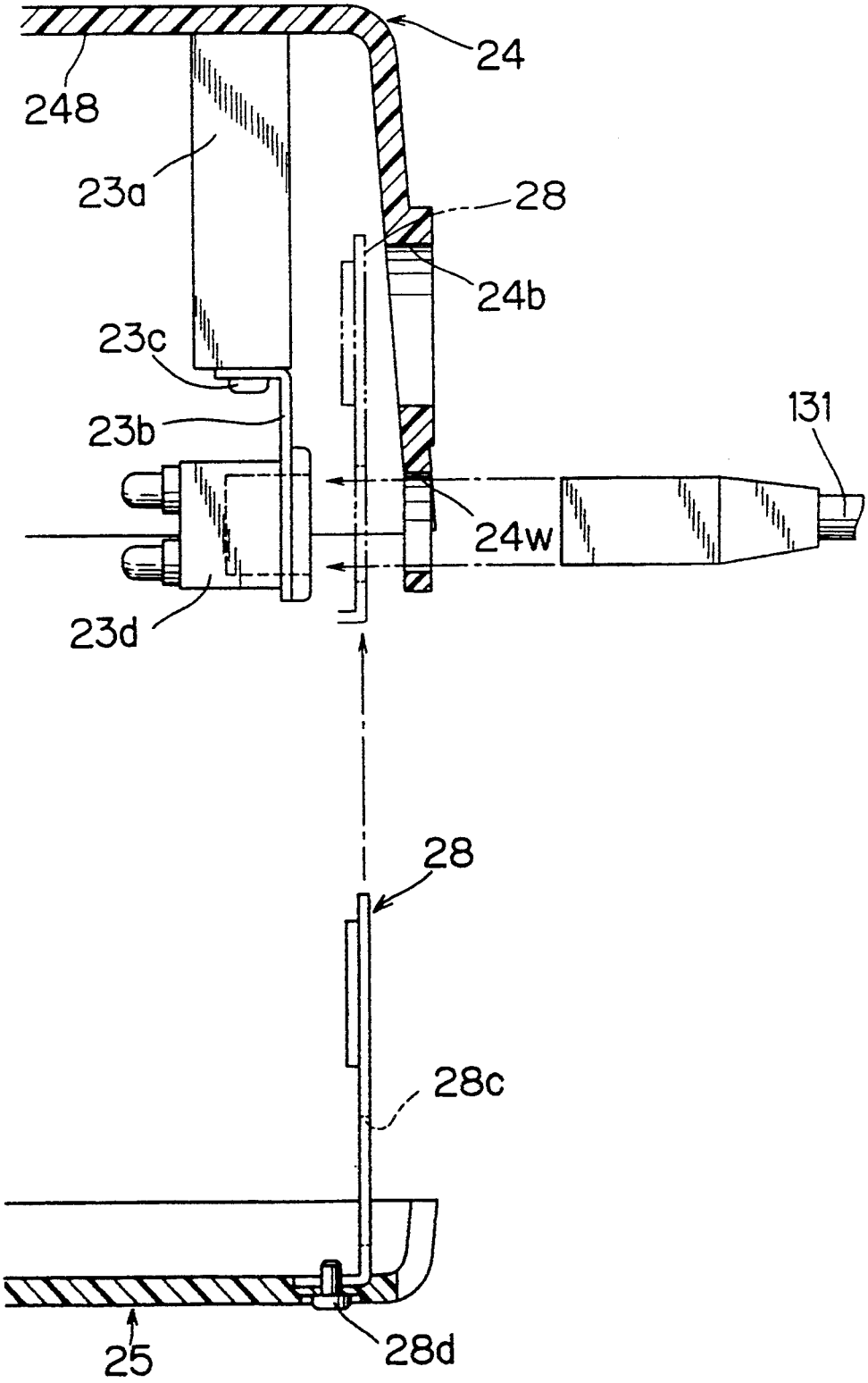
FIG. 10 is an exploded section view of main portions of the apparatus shown in FIG. 1, illustrating the state where the upper casing, the lower casing and a plug are not yet connected to one another.

The plug 132 as engaged with both casings 24, 25 prevents the casings 24, 25 from being separated from each other. Thus, the plug 132 serves as opening preventive means for preventing the inside of the main body 2 from being opened and exposed in the state where electric power can be supplied to the functional components in the main body 2. Only at the time when the plug 132 is disconnected from the plug connector 23*d* to disconnect the power supply line 131 from the power transformer and the like in the main body 2, the engagement of the casings 24, 25 through the attaching members 28 is released, enabling the casings 24, 25 to be separated from each other as shown in FIG. 10. This improves the safety of the apparatus at the time when the casings 24, 25 are separated from each other to cause the apparatus inside to be exposed. This also eliminates the necessity of independently disposing a safety switch which involves the likelihood of erroneous operation and which increases the number of component elements.

Figure 11:
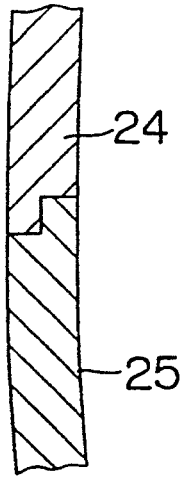
FIG. 11 is an enlarged section view of main portions of the apparatus shown in FIG. 1, illustrating the upper casing and the lower casing as fitted to each other.

The abutting portions of the upper casing 24 and the lower casing 25 are preferably combined with each other in a ship-lap or rabbet joint structure as shown in FIG. 11. Such a structure prevents light from entering into the main body 2 from the abutting portions of the casings 24, 25. This effectively prevents the photosensitive drum 42 from being deteriorated by such light.

At the boundary between the casings 24, 25, the paper feed port 26 and the paper discharge port 21 are formed by the notches 24*a* in the upper casing 24 and notches 25*g* in the lower casing 25. As shown in FIGS. 2 and 3, the boundary between the casings 24, 25 is located under the horizontal surface including the axis of rotation r of the photosensitive drum 42. This makes it difficult for external light, dust and the like coming from the openings such as the paper feed port 26, the paper discharge port 21 and the like reach the photosensitive drum 42. This restrains the photosensitive drum 42 from being fatigued by light or the like which would lower the durability thereof. This also restrains the surface of the photosensitive drum 42 from being damaged by dust.

In a conventional image forming apparatus of the so-called clamshell type, the upper casing can be opened and closed by rotating the upper casing around a predetermined support shaft attached to the lower casing. In this conventional apparatus, it is required to balance the weight of the upper casing with that of the lower casing in order to prevent the main body from turning over with the opened upper casing supported by the lower casing. Accordingly, the conventional image forming apparatus of the clamshell type is required to be arranged such that the vertical level of the boundary between the upper casing and the lower casing forming the apparatus main body is located substantially in the center part of the apparatus main body where the axis of rotation of the photosensitive drum is located.

In the structure as in the present embodiment where the upper casing 24 and the lower casing 25 can be separated from each other, no restrictions are imposed on the vertical level of the boundary between the upper casing 24 and the lower casing 25, unlike in the clamshell-type apparatus. Thus, the vertical level of the boundary can be optionally set. It is therefore possible to set the vertical level of the boundary to a position lower than the axis of rotation r of the photosensitive drum 42 and apart by a predetermined distance therefrom, as done in the embodiment above-mentioned. It is noted that the vertical level of the boundary can be set to a position higher than the axis of rotation r.

As shown in FIG. 2, the boss portions 24*n* at the four corners of the upper casing 24 are located in the lowermost parts of the upper casing 24 to which the functional components are attached. Accordingly, when placing the upper casing 24 as separated from the lower casing 25 on the top surface of a desk or the like, the upper casing 24 can be supported by the boss portions 24*n*. Thus, since the boss portions 24*n* can be utilized as leg portions, the upper casing 24 which may be removed for jam processing or the like, can be placed, as it is, on the top of a desk or the like. This not only facilitates jam processing or the like, but also prevents the functional components from being carelessly damanged when the upper casing 24 is removed. Further, a special stand or the like is not required on which the upper casing 24 as removed is placed.

Schematic Arrangement of the Document Delivery Means

Figure 15:
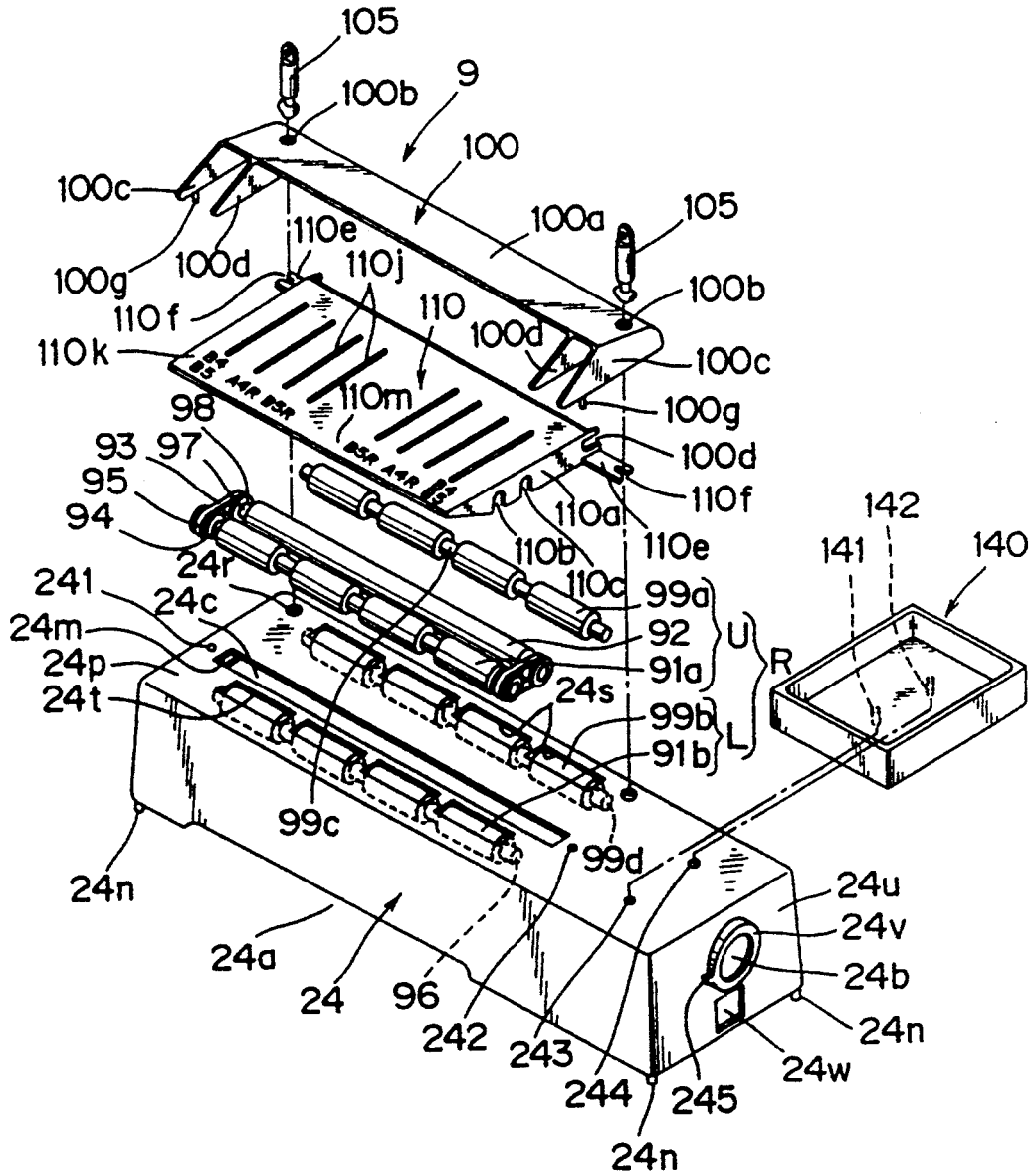
FIG. 15 is an exploded perspective view of main portions of the apparatus shown in FIG. 1, illustrating document delivery means, a small-article container and the upper casing thereof.

Referring to FIGS. 2 and 15, the document delivery means 9 comprises (i) the roller means R for delivering a document d along the top surface 24*p*, (ii) the lower cover 110 which partially covers above the top surface 24*p* and which also serves as holding means for rotatably holding upper roller means U out of the roller means R, and (iii) an upper cover 100 which partially covers above the lower cover 110. The upper cover 100 and the lower cover 110 are removably attached to the top surface 24*p* of the upper casing 24 by a pair of connecting members 105 made of resin or the like.

Referring to FIGS. 1 and 2, there are formed, between the upper cover 100 and the lower cover 110, the document insertion port 90*a* and an upper delivery passage 90*d*, to be discussed later, which communicates with the document insertion port 90*a*. Formed between the top surface 24*p* of the upper casing 24 and the lower cover 110 are the document discharge port 90*b* and a lower delivery passage 90*e*, to be discussed later, which communicates with the document discharge port 90*b*. In other words, the top surface 24*p* of the upper casing 24, the lower cover 110 and the upper cover 100 serve as document guides for guiding a document d in predetermined directions. The downstream end of the upper delivery passage 90*d* communicates with the upstream end of the lower delivery passage 90*e* at an inverting passage 90*f*.

Roller Means

The roller means R comprises the upper roller means U adapted to come in contact with the top surface of a document d, and lower roller means L adapted to come in contact with the underside of the document d. The upper roller means U comprises three different types of upper delivery rollers 99*a*, 92, 91*a*, and roller shafts 99*c*, 94, 91*c* which are integrally rotatably attached to the upper delivery rollers 99*a*, 92, 91*a*, respectively, and which are rotatably held by the lower cover 110 serving as the holding means. The lower roller means L comprises two different types of lower delivery rollers 99*b*, 91*b* to be driven by the drive means 7 in the main body 2, and roller shafts 99*d*, 96 which are integrally rotatable with the lower delivery rollers 99*b*, 91*b*, respectively, and which are rotatably supported by the upper casing 24.

The upper delivery rollers 99*a* and the lower delivery rollers 99*b* form a pair and are adapted to deliver the document d as held therebetween. The upper delivery rollers 91*a* and the lower delivery rollers 91*b* form a pair and are adapted to deliver the document d as held therebetween. The upper delivery rollers 91, 99*a* are rotated as following the rotation of the lower delivery rollers 91*b*, 99*b*, respectively. The lower delivery rollers 99*b*, 91*b* are synchronously driven. Between parts of the peripheral surfaces of the upper delivery rollers 99*a* and a guide surface 100*k*, to be discussed later, of the upper cover, there is formed the inverting passage 90*f* for inverting a document d delivered from the upper delivery passage 90*d*, causing the document d to be guided to the lower delivery passage 90*e*. The upper delivery rollers 99*a* also serve as inverting rollers for inverting a document d.

As each of the upper delivery rollers 99*a*, 91*a*, a plurality of rollers are disposed along each of the roller shafts 99*c*, 94 at regular spatial intervals. As mentioned above, the roller shafts 99*c*, 94 are rotatably supported by the lower cover 110. Accordingly, the upper delivery rollers 99*a*, 91*a* are rotatably supported through the roller shafts 99*c*, 94 by the lower cover 110 serving as the holding means. As each of the lower delivery rollers 99*b*, 91*b* forming respective pairs together with the upper delivery rollers 99*a*, 91*a*, a plurality of rollers are disposed along each of the roller shafts 99*d*, 96 at regular spatial intervals. As mentioned above, the roller shafts 99*d*, 96 are rotatably supported by the upper casing 24. Accordingly, the lower delivery rollers 99*b*, 91*b* are rotatably supported by the upper casing 24 through the roller shafts 99*d*, 96.

In the top surface 24*p* at the rear side of the upper casing 24, a plurality of slits 24*s* are formed in one row at regular spatial intervals along the longitudinal direction of the upper casing 24. The upper parts of the peripheral surfaces of the lower delivery rollers 99*b*, as projecting from the slits 24*s*, come in contact with the lower parts of the peripheral surfaces of the upper delivery rollers 99*a*. Likewise, the upper parts of the peripheral surfaces of the lower delivery rollers 91*b*, as projecting through slits 24*t*, come in contact with the lower parts of the peripheral surfaces of the upper delivery rollers 91*a*.

The upper delivery roller 92 is a long white roller which slidably comes in contact with the transparent platen 11*a* at the rear side of the main body 2 with respect to the upper delivery rollers 91*a* (at the upstream side of the document delivery direction). The upper delivery roller 92 is integrally rotatably attached to the roller shaft 97. Since the roller shaft 97 is rotatably supported by the lower cover 110, the upper delivery roller 92 is rotatably supported by the upper cover 100. The upper delivery roller 92 is adapted to push a document d downward such that the document d is delivered securely along the transparent platen 11*a*. The roller shaft 97 is provided at both ends thereof with transmission rollers 98 rotatable integrally with the roller shaft 97. The roller shaft 94 of the upper delivery rollers 91*a* is provided at both ends thereof with transmission rollers 95 rotatable integrally with the roller shaft 94. Endless belts 93 are wound between the transmission rollers 95 and the transmission rollers 98. Accordingly, the upper delivery roller 92 is rotated following the rotation of the upper delivery rollers 91*a* through the transmission rollers 95, 98 and the belt 93.

Upper Cover

Figure 16:
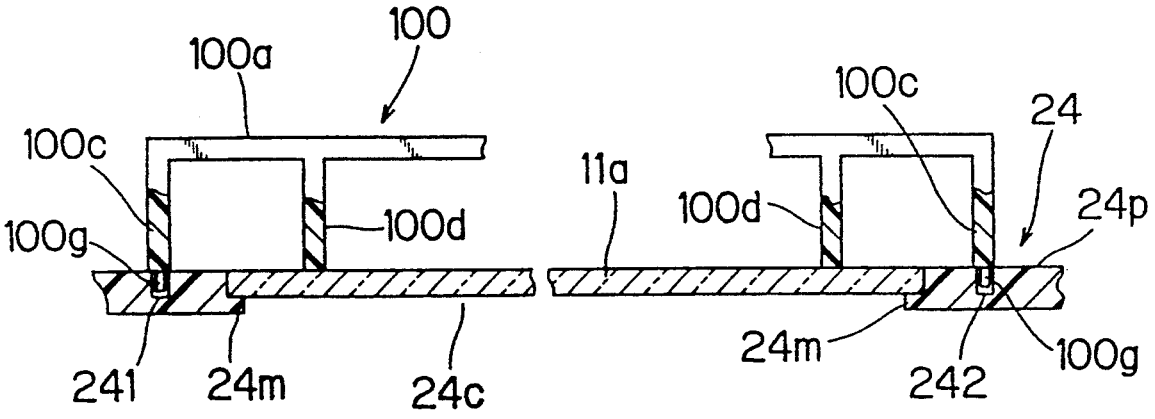
FIG. 16 is a section view of main portions of the apparatus shown in FIG. 1, illustrating how an upper cover of the document delivery means and the upper casing are attached to each other.
Figure 17:
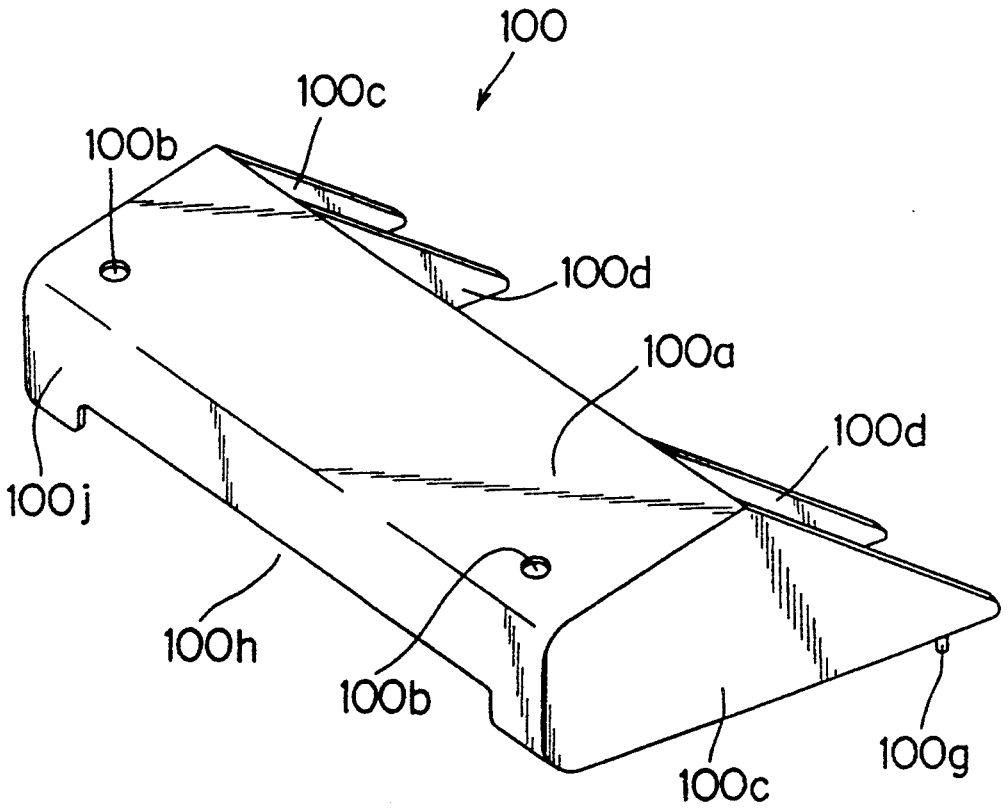
FIG. 17 is a perspective view of the upper cover shown in FIG. 16.

Referring to FIGS. 15 to 17, the following description will discuss the upper cover 100. The upper cover 100 is long as extending in the direction at a right angle to the delivery direction. The upper cover 100 comprises a top surface 100*a* substantially parallel with the top surface 24*p* of the upper casing 24, a rear surface 100*j* continuously extending from the top surface 100*a*, and a pair of lateral surfaces 100*c* each made substantially in the form of a trapezoid. The lateral surfaces 100*c* are provided at the lower ends of the front sides thereof with projections 100*g*. The projections 100*g* are respectively inserted into a pair of concaves 241, 242 which are formed in the top surface 24*p* of the upper casing 24 in the vicinity of the both ends of the slit 24*c* and which are located in a perpendicular plane including the axis of rotation r of the photosensitive drum 42 (See FIG. 16).

With reference to FIG. 17, the rear surface 100*j* is provided at the lower end thereof with a notch 100*h* for forming, between the rear surface 100*j* and the top surface 24*p* of the upper casing 24, an opening 90*c* serving as a bypass introduction port through which a document d is introduced from the rear side of the main body 2 directly into the lower delivery passage 90*e* without the document d inverted. The rear surface 100*j* is provided at the inner peripheral surface thereof with the arcuate guide surface 100*k* extending substantially along the peripheral surfaces of the upper delivery rollers 99*a* (see FIG. 2). The guide surface 100*k* is adapted to guide the tip of a document d to the mutual contact portions of the upper and lower delivery rollers 99*a*, 99*b* such that the tip of the document d inserted through the document insertion port 90*a* from the front side of the main body 2 is satisfactorily held by the upper and lower delivery rollers 99*a*, 99*b*.

With reference to FIG. 17, the top surface 100*a* is provided in both longitudinal ends thereof with a pair of through-holes 100*b* through which the connecting members 105 are passed. The through-holes 100*b* are so formed as to pierce the bottoms 100*m* of boss portions 100*e* which project under the top surface 100*a* (See FIG. 20). Referring to FIGS. 16 and 17, a pair of ribs 100*d* parallel with the lateral surfaces 100*c* are formed under the top surface 100*a* with predetermined distances provided between the lateral surfaces 100*c* and the ribs 100*d*. As shown in FIG. 16, the height of each rib 100*d* is set such that the ribs 100*d* hold down both longitudinal ends of the transparent platen 11*a* when the upper cover 100 is attached to the top surface 24*p* of the upper casing 24.

Since the ribs 100*d* of the upper cover 100 hold down and fix the transparent platen 11*a*, transparent platen holding members are not required to be independently disposed. This reduces the number of component elements and the production cost.

By removing the upper cover 100, the transparent platen 11*a* can be readily removed and attached. This facilitates maintenance of the apparatus for which disassembling and assembling are required. Further, the assembling cost can be reduced, thus further reducing the production cost.

Lower Cover

With reference to FIG. 15, the lower cover 110 has a top surface 110*m* substantially parallel with the top surface 24*p* of the upper casing 24, and a pair of lateral surfaces 110*a* each made substantially in the form of a trapezoid. Formed on the top surface 110*m* are projections 110*j* serving as document positioning marks, which are disposed at positions corresponding to a variety of document sizes along the delivery direction. There are also marked displays 110*k* representing the document sizes to which the projections 110*j* respectively correspond. Since the positioning projections 110*j* are formed on the top surface 110*m* of the lower cover 110, document positioning is facilitated. Further, since a document can be positioned by the projections 110*j* of the lower cover 110 and the marks 121*a* put on the carrying portion 121 of the handle 120 mentioned earlier, the document can be positioned very accurately. Instead of the projections 110*j* on the top surface 110*m* of the lower cover 110, concaves may be used.

The lateral surfaces 110*a* are provided in the front sides thereof with downwardly opened notches 110*b*, 110*c*. The lateral surfaces 110*a* are provided in the rear sides thereof with rearwardly opened notches 110*d*. Rotatably fitted to the notches 110*b* is the roller shaft 94 at its portions between the upper delivery rollers 91*a* and the transmission rollers 95. Rotatably fitted to the notches 110*c* is the roller shaft 97 at its portions between the upper delivery roller 92 and the transmission rollers 98. The roller shaft 99*c* of the upper delivery rollers 99*a* is rotatably fitted into the nothces 110*d*.

Figure 18:
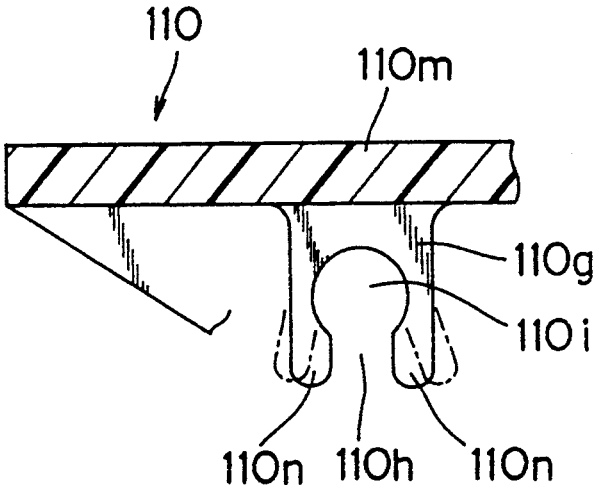
FIG. 18 is a schematic section view of main portions of a lower cover of the document delivery means.

As shown in FIG. 18, the lower cover 110 is provided at the top surface 110*m* thereof with at least a pair of plate-like hanging pieces 110*g* for supporting the shaft. Each of the hanging pieces 110*g* has a pair of resiliently deformable projecting pieces 110*n*, a downwardly opened cut groove 110*h* formed between the projecting pieces 110*n*, and a shaft support portion 110*i* continuously formed at the inner part of the cut groove 110*h* and made in the form of a circular concave which can support the roller shaft 94. The roller shaft 94 is passed through the cut grooves 110*h* of which widths have been once broadened by resiliently deforming the projecting pieces 110*n* (as shown by chain lines in FIG. 18), and then introduced into the shaft support portions 110*i*. Thereafter, the projecting pieces 110*n* are returned to the original positions (as shown by solid lines in FIG. 18), thus preventing the roller shaft 94 from coming off from the cut grooves 110*h*. Although not shown, the roller shafts 99*c*, 97 of the upper delivery rollers 99*a*, 92 are supported by the lower cover 110 by the similar arrangements.

As shown in FIG. 15, the lateral surfaces 110*a* are provided at the lower portions of the rear sides thereof with stay portions 110*e* which come in contact with the top surface 24*p* of the upper casing 24, the stay portions 110*e* outwardly projecting from the lateral surfaces 110*a*. The stay portions 110*e* have cut grooves 110*f* which are outwardly opened.

In the embodiment above-mentioned, the upper cover 100 holds and fixes the transparent platen 11*a*.

Alternatively, the lower cover 110 may have ribs for holding and fixing the transparent platen 11*a*.

Positioning the upper and Lower Covers

Figure 19:
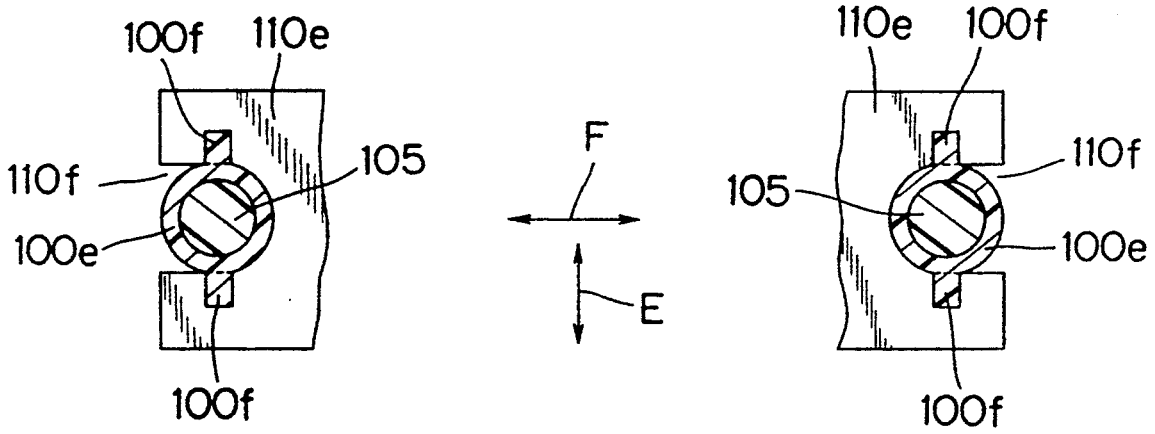
FIG. 19 is a section view in plan elevation of main portions of the upper cover and the lower cover as engaged to each other.
Figure 20:
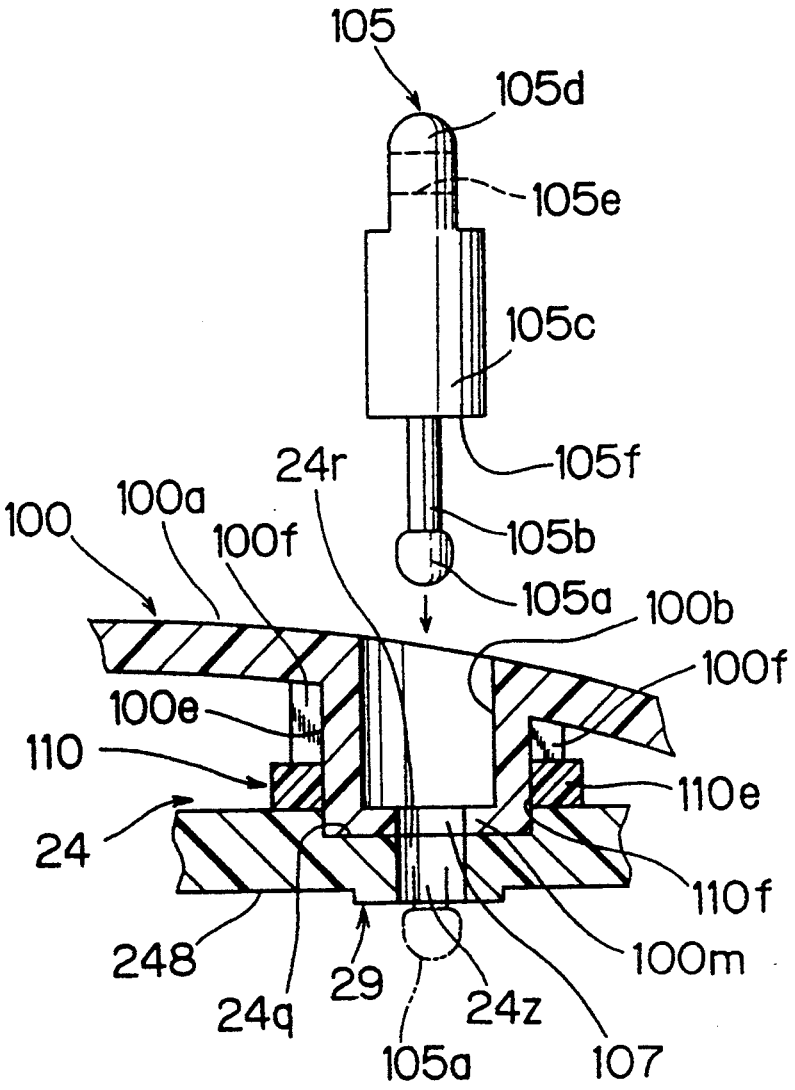
FIG. 20 is an exploded section view of the upper cover and the lower cover which are not yet connected to each other by connecting members.

Referring to FIGS. 15, 19 to 23, the following description will discuss how the upper cover 100 and the lower cover 110 are positioned with respect to the upper casing 24. In FIG. 20, the upper cover 100 is positioned with respect to the upper casing 24 in the front-to-back and transverse directions by fitting the boss portions 100*e* of the upper cover 100 to the upper inner peripheral portions of the through-holes 24*r* of the upper casing 24. The upper cover 100 is positioned with respect to the upper casing 24 in the vertical direction by striking the lower end surfaces of the bottoms 100*m* of the boss portions 100*e* against step portions 24*q* in the through-holes 24*r*.

The lower cover 110 is positioned with respect to the upper casing 24 in the front-to-back and transverse directions by regulating the relative positional relationship with respect to the upper cover 100 thus positioned with respect to the upper casing 24 (See FIG. 19). More specifically, as shown in FIG. 19, the upper cover 100 and the lower cover 110 are relatively positioned in the front-to-back direction E and the transverse direction F by fitting the cut grooves 110*f* in the stay portions 110*e* of the lower cover 110 to the outer peripheral surfaces of the boss portions 100*e* of the upper cover 100. Each of the boss portions 100*e* is provided at the outer peripheral portion thereof with a pair of holding ribs 100*f* vertically extending to the intermediate part of each boss portion. The stay portions 110*e* of the lower cover 110 are held by and between the holding ribs 100*f* and the top surface 24*p* of the upper casing 24. Thus, the lower cover 110 is positioned with respect to the upper casing 24 in the vertical direction.

Positioning the upper cover 100 with respect to the upper casing 24 is made by fitting the boss portions 100*e* of the upper cover 100 into the through-holes 24*r* in the upper casing 24, and positioning the lower cover 110 with respect to the upper casing 24 is made by positioning the lower cover 110 with respect to the boss portions 100*e*. In other words, positioning the upper cover 100 and the lower cover 110 with respect to the upper casing 24 is made based on the fitting of the boss portions 100*e* into the through-holes 24*r*. Thus, such positioning is very easy.

Connecting Members and Cam Surfaces

Figure 21:
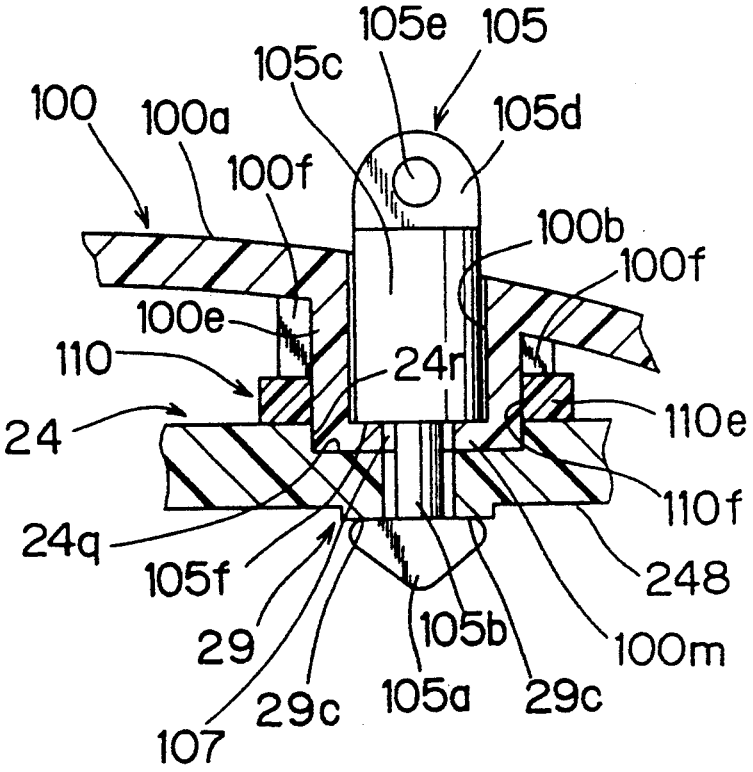
FIG. 21 is a section view of the upper cover and the lower cover as connected to each other by the connecting members.

As shown in FIG. 20, the upper cover 100 and the lower cover 110 positioned in the manner above-mentioned, are attached to the upper casing 24 by the connecting members 105. Referring to FIGS. 20 and 21, each of the connecting members 105 successively has (i) a head portion 105*d* including a pair of parallel lateral walls such that each connecting member 105 can be rotated with the head portion 105*d* held, (ii) a cylindrical trunk portion 105*c*, (iii) a smaller-diameter portion 105*b* and (iv) an arrowhead-like portion 105*a* substantially in the form of a triangle, in this order from above. The underside surfaces 105*f* of the trunk portions 105*c* form first engagement portions to be engaged with the upper cover 100. The arrowhead-like portions 105*a* include second engagement portions to be engaged with the upper casing 24. The head portions 105*d* have insertion holes 105*e* for preventing the fingers from slipping. Provision may be made such that a tool such as a screwdriver can be inserted into the insertion holes 105*e*, so that the connecting members 105 can be rotated with the use of such a tool, in addition to manual rotation.

Figure 22:
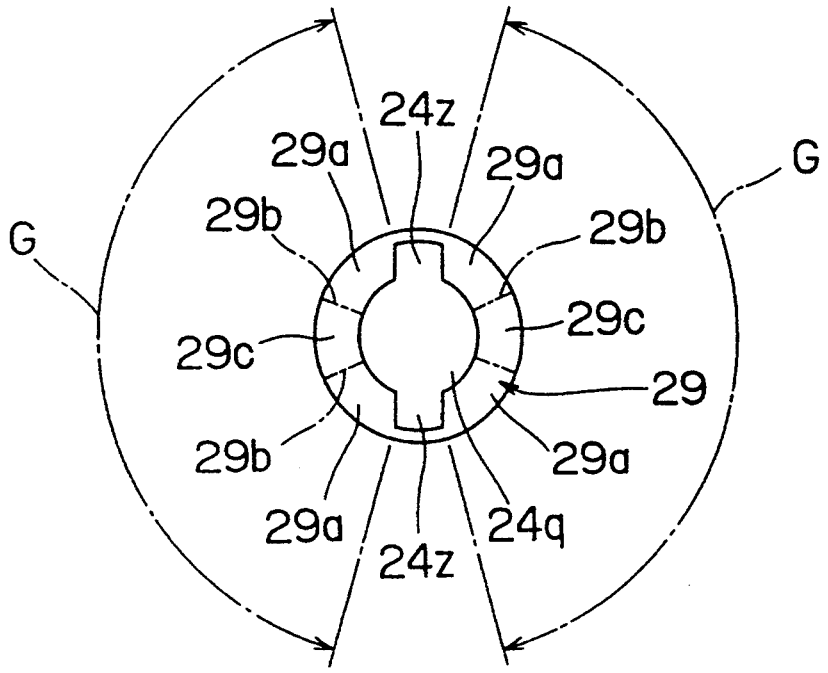
FIG. 22 is a bottom view of the top surface of the upper casing, illustrating cam surfaces.

Each of the through-holes 24*r* in the top surface 24*p* of the upper casing 24 has a pair of vertically extending grooves 24*z* such that each arrowhead-like portion 105*a* can pass through each through-holes 24*r* only at the time when the arrowhead-like portion 105*a* is turned in a predetermined direction (See FIG. 22). Grooves similar to the grooves 24*z* are also formed in those portions 107 of the through-holes 100*b* in the upper cover 100, which are pierced in the bottoms 100*m* of the boss portions 100*e*.

Cam surfaces 29 to be engaged with the arrowhead-like portions 105*a* of the connecting members 105 are formed around the through-holes 24*r* in the inner upper surface 248 of the upper casing 24. When the head portions 105*d* of the connecting members 105 passing through the through-holes 100*b* in the upper cover 100 and the through-holes 24*r* in the upper casing 24 are engaged with the cam surfaces 29, the underside surfaces 105*f* of the trunk portions 105*c* of the connecting members 105 come in contact with the top surfaces of the bottoms 100*m* of the boss portions 100*e* of the upper cover 100.

Figure 23:
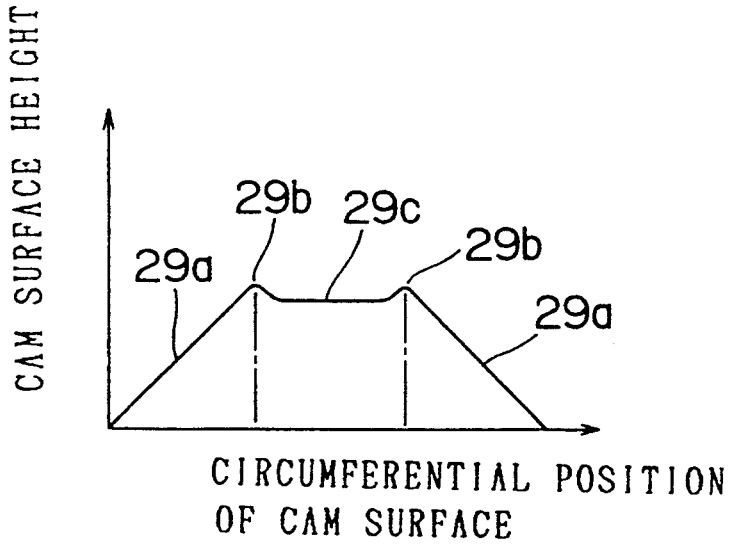
FIG. 23 is a view illustrating the relationship between the circumferential positions of the cam surfaces and the cam surface heights.

The heights (downwardly projecting lengths) of the cam surfaces 29 are so set as to vary, in a predetermined manner as shown in FIG. 23, in areas G between the grooves 24*z* shown in FIG. 22. More specifically, holding portions 29*c* having predetermined heights are formed at the centers of the areas G, and a pair of inclined portions 29*a* are formed from each of the holding portions 29*c* toward the grooves 24*z*. The highest portions of the inclined portions 29*a* form peaks 29*b* such that the holding portions 29*c* are lower than the highest portions above-mentioned. The peaks 29*b* restrain the arrowhead-like portions 105*a* engaged with the holding portions 29*c* from moving toward the inclined portions 29*a*. The arrowhead-like portions 105*a* of the connecting members 105 are passed through the grooves in the through-holes 100*b* in the upper cover 100 and the grooves 24*z* in the through-holes 24*r*, and downwardly project under the top surface 24*p* of the upper casing 24 (as shown by two-chain lines in FIG. 20). Thereafter, the connecting members 105 are rotated by about 90° so that the arrowhead-like portions 105*a* are passed through the inclined portions 29*a* and peaks 29*b* of the cam surfaces 29, and move to the holding portions 29*c* (See FIG. 21).

The lengths of the smaller-diameter portions 105*b* of the connecting members 105 are set such that, when the arrowhead-like portions 105*a* are located in intermediate parts of the inclined portions 29*a*, downwardly pushing forces are applied to the arrowhead-like portions 105*a* by the cam surfaces 29. On the other hand, the underside surfaces 105*f* of the trunk portions 105*c* come in contact with the top surfaces of the bottoms 100*m* of the boss portions 100*e* of the upper cover 100, thereby to restrain the underside surfaces 105*f* from downwardly moving. Accordingly, when the pushing forces are applied to the arrowhead-like portions 105*a* as above mentioned, there are generated stretching forces for stretching the smaller-diameter portions 105*b*. The smaller-diameter portions 105*b* receive the stretching forces thus generated according to the engagement positions of the arrowhead-like portions 105*a* with the cam surfaces 29, and then expand or contract. Between the arrowhead-like portions 105*a* and the cam surfaces 29, there are generated pushing forces by resilient restoring forces of the smaller-diameter portions 105*b*, correspondingly to the amounts of stretch of the smaller-diameter portions 105*b*. Accordingly, the engagements of the arrowhead-like portions 105*a* with the holding portions 29*c* of the cam surfaces 29 are further assured.

As discussed in the foregoing, the upper cover 100 and the lower cover 110 which are elements constituting the document delivery passages 90*d*, 90*e*, are removably attached to the upper casing 24 by the pair of removable connecting members 105. Accordingly, at the time of jam processing, the upper and lower delivery passages 90*d*, 90*e* can be fully opened simultaneously by removing the covers 100, 110. This facilitates the removal of a document d which has lodged in the delivery passages 90*d*, 90*e*. Further, the document d can be removed with no damage thereto.

Since the covers 100, 110 are positioned with respect to the upper casing 24 by the pair of connecting members 105, such positioning is facilitated. Further, the covers 100, 110 are attached to the upper casing 24 with the use of resiliency of the connecting members 105 made of resin. This simplifies the structure and reduces the number of component elements and the production cost as compared with the arrangement where spring members are independently disposed.

Operation of Document Delivery Means

Figure 24:
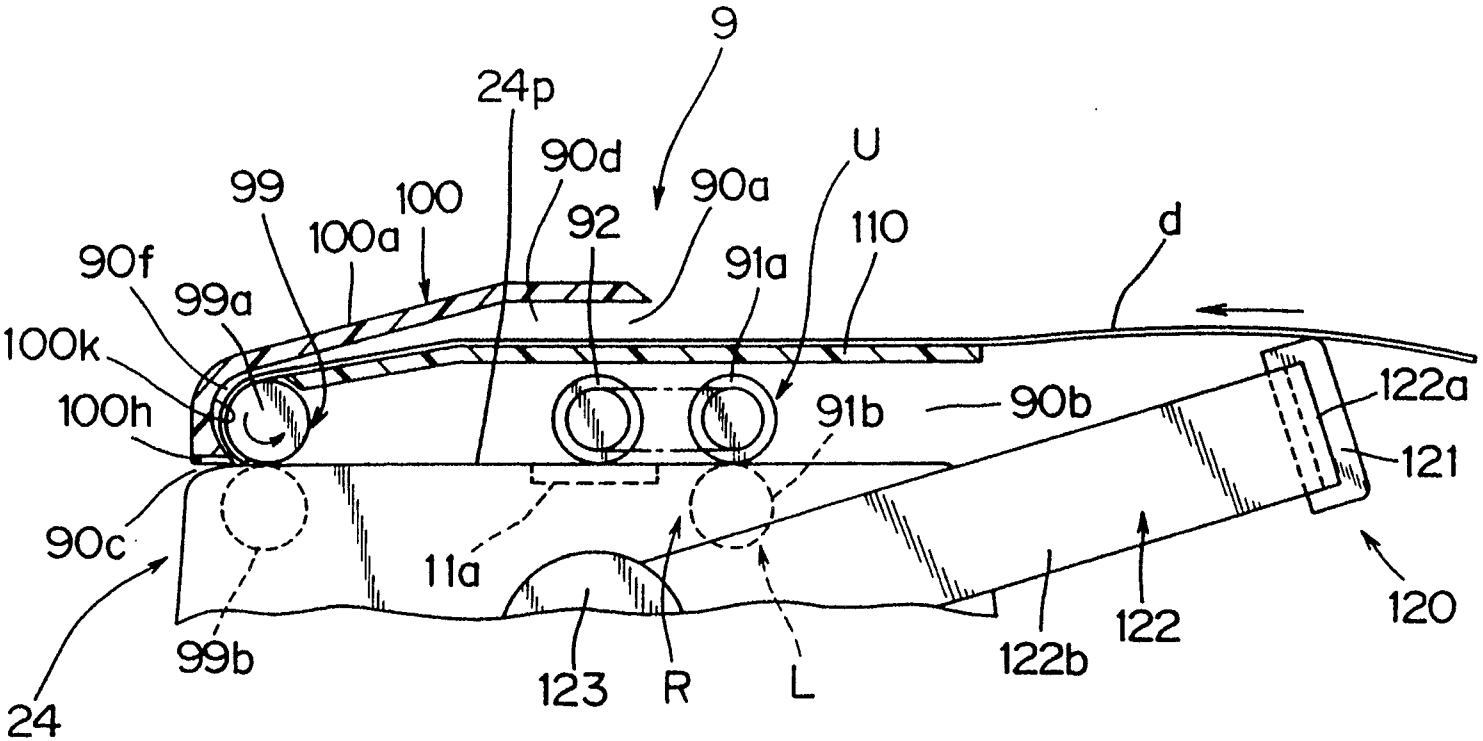
FIG. 24 is a schematic section view of the document delivery means in which a document is set.

The following will discuss the operation of the document delivery means 9. From the front side of the main body 2, a document d is inserted into the upper delivery passage 90*d* through the document insertion port 90*a* between the upper cover 100 and the lower cover 110. While the tip of the document d is curved along the upper delivery rollers 99*a* by the arcuated guide surface 100*k* of the upper cover 100 as shown in FIG. 24, the document d is introduced until the tip of the document d reaches the contact portions of the upper delivery rollers 99*a* with the lower delivery rollers 99*b*.

Figure 25:
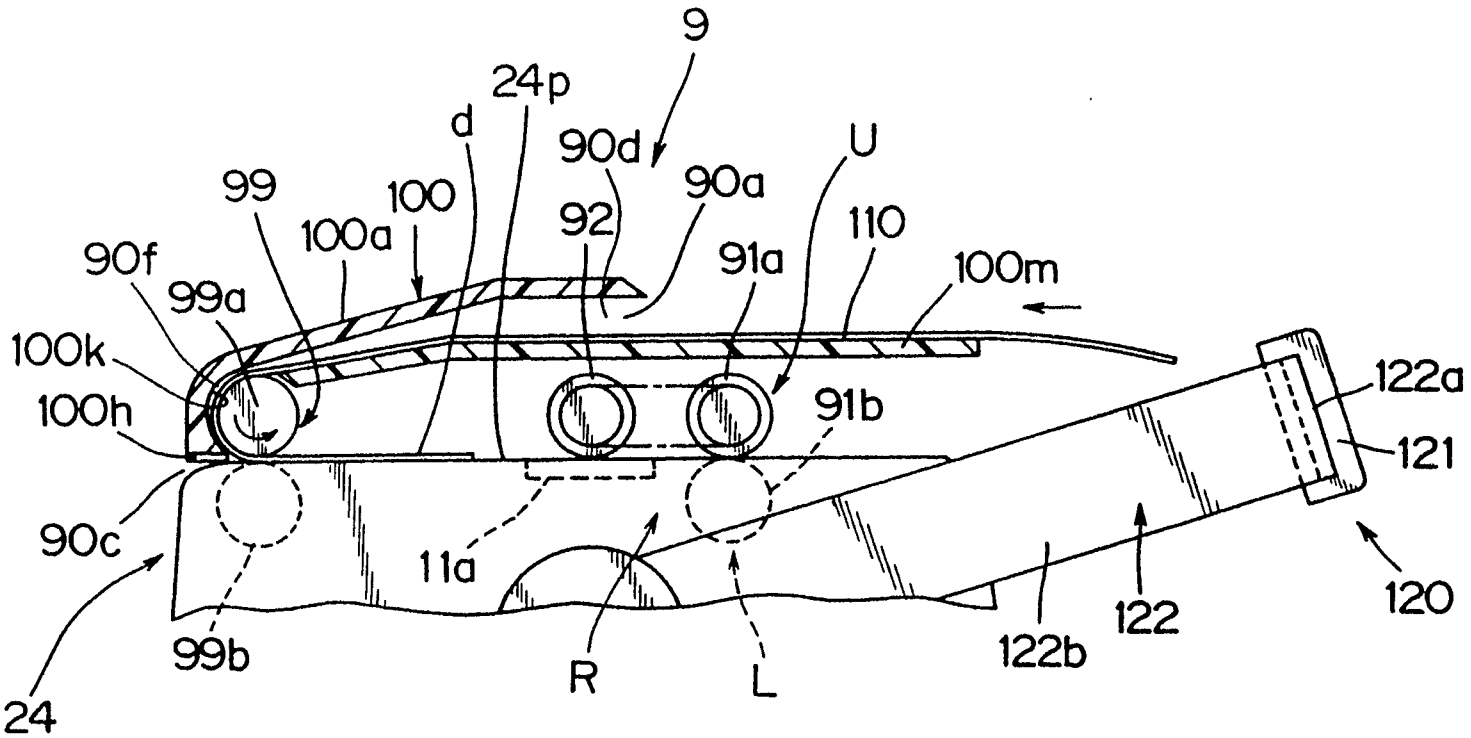
FIG. 25 is a schematic section view of the document delivery means where the document is under delivery.

With the document d thus set, a reproduction start switch (not shown) is turned on. As shown in FIG. 25, the document d as held by and between the delivery rollers 99*a*, 99*b*, is inverted thereby and delivered toward the upper delivery roller 92 in the lower delivery passage 90*e*.

Figure 26:
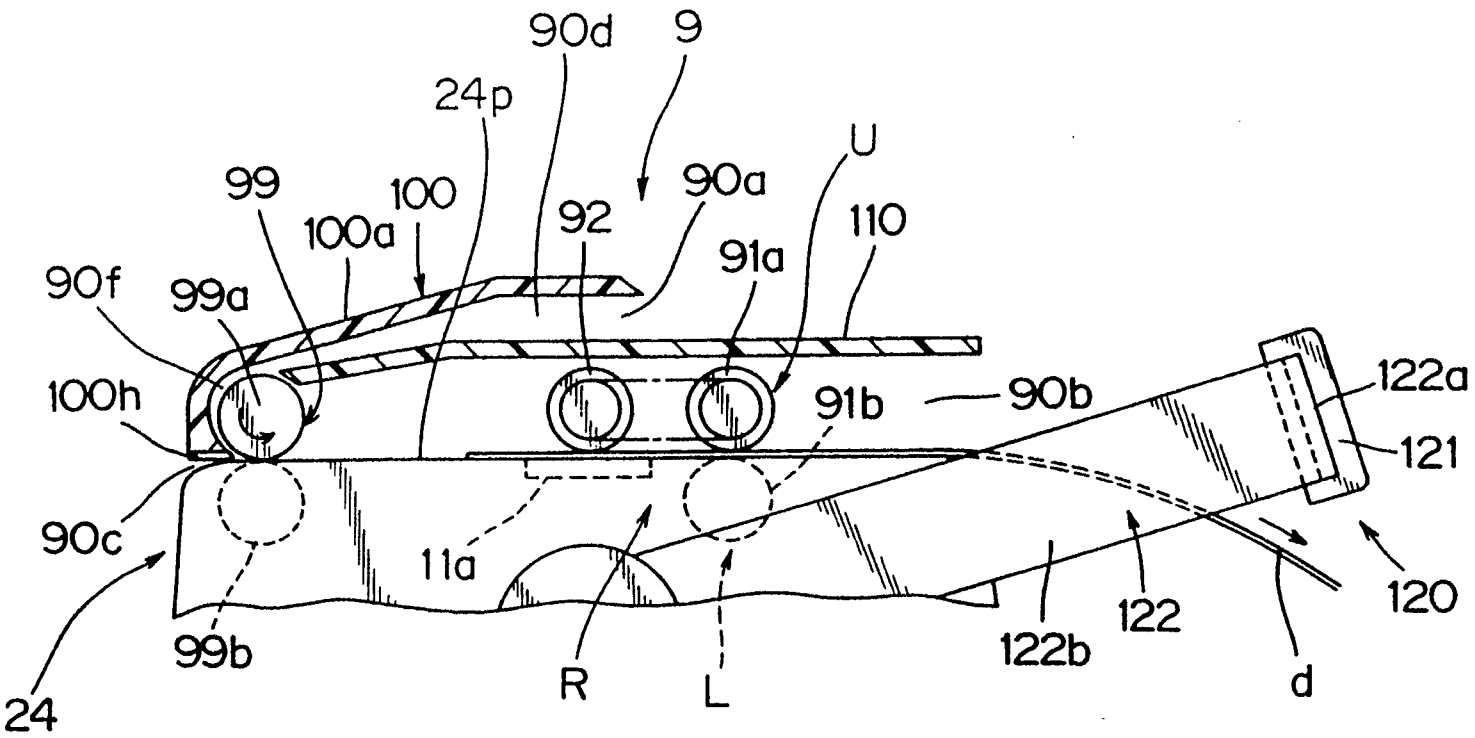
FIG. 26 is a schematic section view of the document delivery means in which the document is under discharge.

As shown in FIG. 26, the document d is delivered along the transparent platen 11*a* by the upper delivery roller 92 and the pair of delivery rollers 91*a*, 91*b*, and then discharged through the document discharge port 90*b*.

Figure 27:
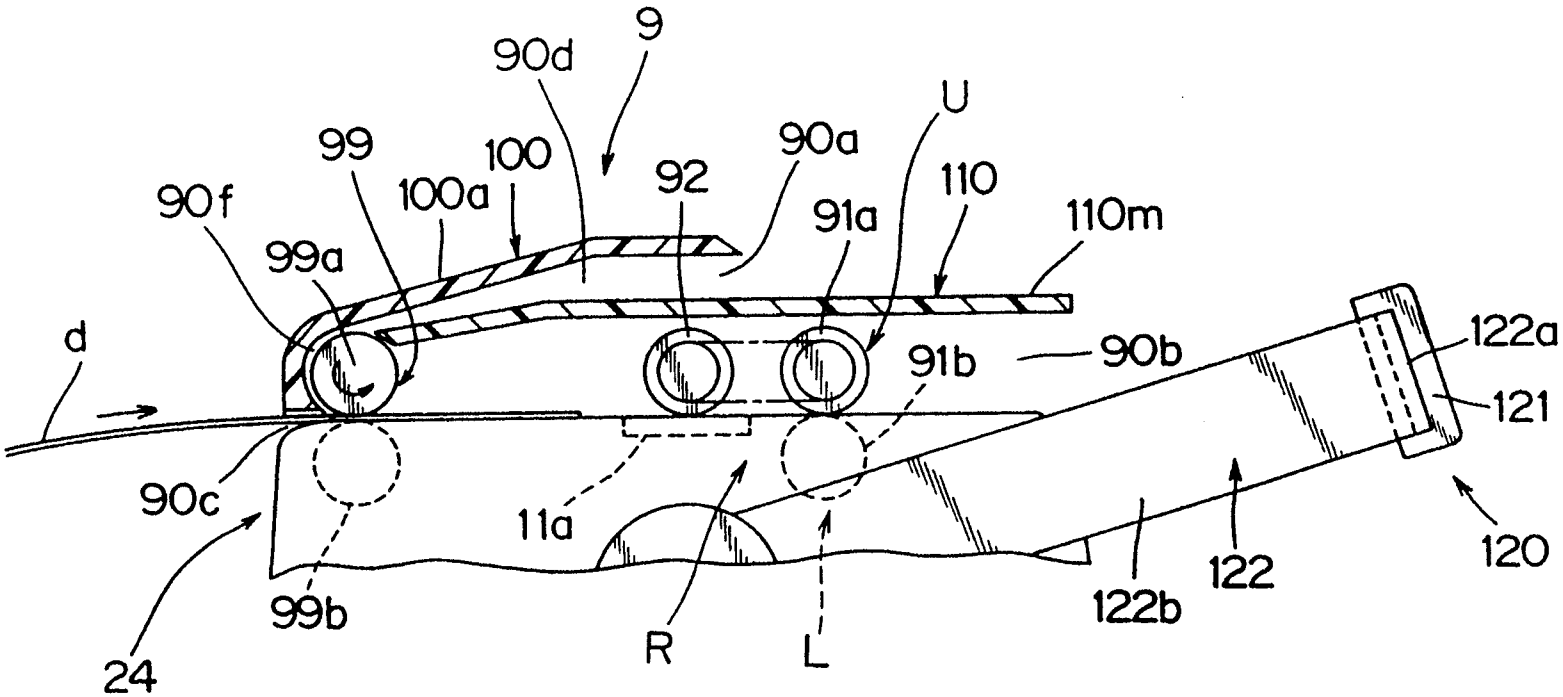
FIG. 27 is a schematic section view of the document delivery means into which a thick document is being introduced.

A document d which can be hardly inverted due to its thickness or the like, can be introduced, as it is and not inverted, directly into the lower delivery passage 90*e* through the opening 90*c* serving as a bypass introduction port, as shown in FIG. 27. The document d is introduced into the lower delivery passage 90*e* without being inverted as done in the case where the document d is introduced into the upper delivery passage 90*d*. Thus, the document d is not curled and does not get into a curl habit. It is therefore not required to provide the upper delivery rollers 99*a* for inverting the document d with such great curvatures as to prevent a thick document d from being curled. Accordingly, small-size rollers can be used as the upper delivery rollers 99*a*, enabling the document delivery means 9 to be made in a compact design. Thus, the entire apparatus can be made in a compact design.

Small-Article Container

As shown in FIG. 15, the document delivery means 9 is disposed near one side of the top surface 24*p* of the upper casing 24, and the small-article container 140 is removably attached on the top surface 24*p*. The small-article container 140 is provided on the bottom thereof with a pair of projections 141, 142. By fitting the projections 141, 142 into a pair of concaves 243, 244 formed in the top surface 24*p* of the upper casing 24, the small-article container 140 can be positioned with respect to the upper casing 24.

The small-article container 140 can be conveniently used for housing small articles such as paper clips or the like. Since the small-article container 140 is disposed on the top surface of the main body 2, the user can identify small articles housed in the container 140 at a glance, enabling the container 140 to be used further conveniently. A variety of small-article containers 140 may be prepared and selectively used according to the user's convenience.

When the small-article container 140, the upper cover 100 and the lower cover 110 are removed, the top surface 24*p* of the upper casing 24 becomes substantially planar, as shown in FIG. 15. In the top surface 24*p* of the upper casing 24, the concaves 241, 242 are formed at positions which lie on a perpendicular plane including the axis of rotation r of the photosensitive drum 42 and which are located in the vicinity of both sides of the transparent platen 11*a*. For example, when attaching, to the top surface 24*p*, attachments such as an LED unit and the like used as latent image forming means for the photosensitive drum 42, the concaves 241, 242 can be used for positioning the attachments above-mentioned. Thus, in cooperation with the fact that the top surface 24*p* is substantially planar, the attachments can be attached as accurately positioned with respect to the photosensitive drum 42 and the like.

Another Example of the Handle

Figure 28:
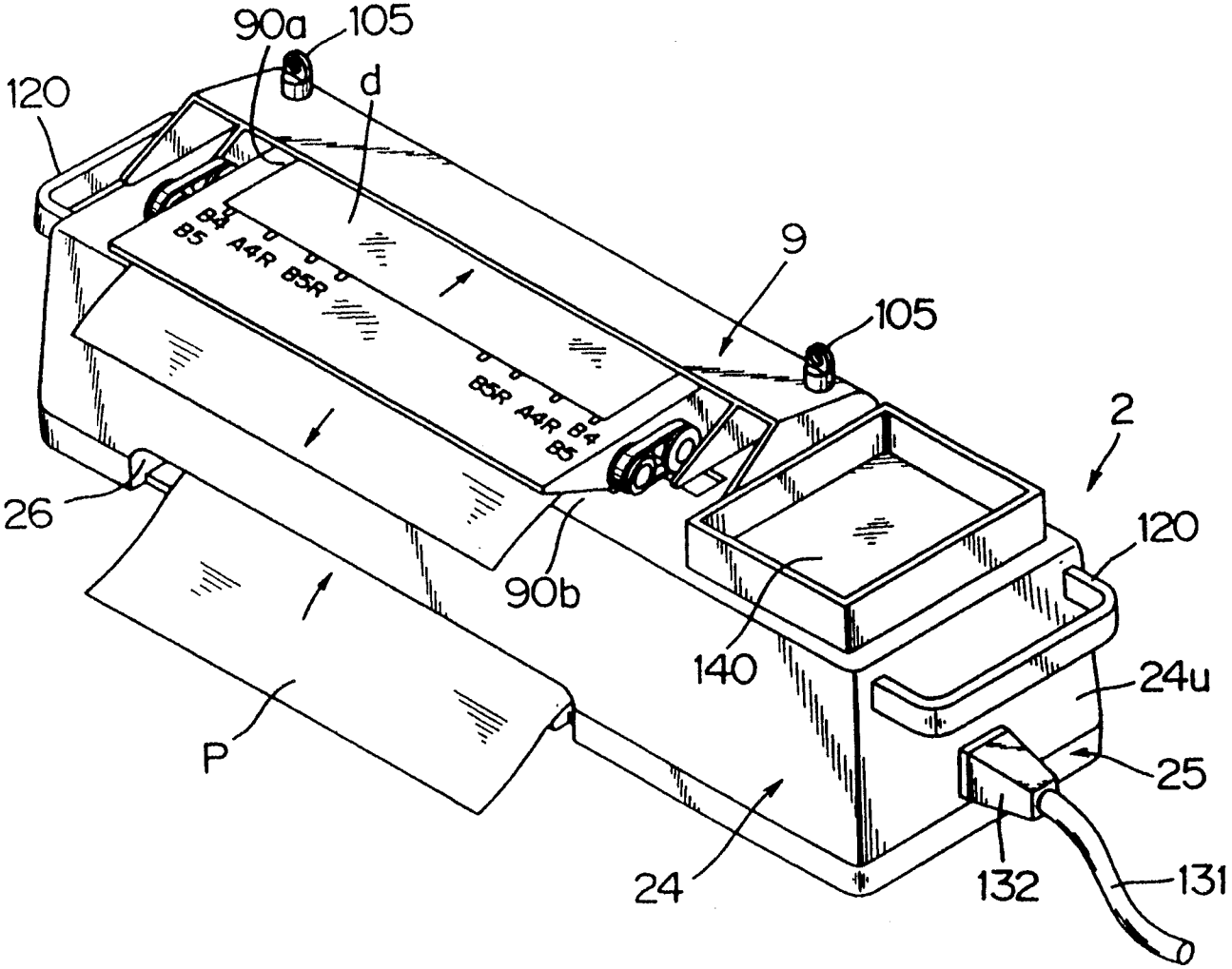
FIG. 28 is a perspective view of the electrophotographic copying apparatus in accordance with a second embodiment of the present invention, in which the handle is modified.

Referring to FIG. 28, the following description will discuss a second embodiment of the present invention where the handle is modified.

The second embodiment differs from the first embodiment shown in FIG. 1 in that a pair of handles 120 integral with the upper casing 24 are formed at both longitudinal ends of the upper casing 24. In the second embodiment in FIG. 28, other arrangements which are the same as those of the first embodiment in FIG. 1 are designated by the same reference numerals used in FIG. 1, and the description of such same arrangements is here omitted.

In the embodiment shown in FIG. 28, the upper casing 24 and the handles 120 are made in a unitary structure and can therefore be formed simultaneously. This eliminates members for attaching the handles 120, thus reducing the production cost.

Another Example of the Fitting Members

Figure 29:
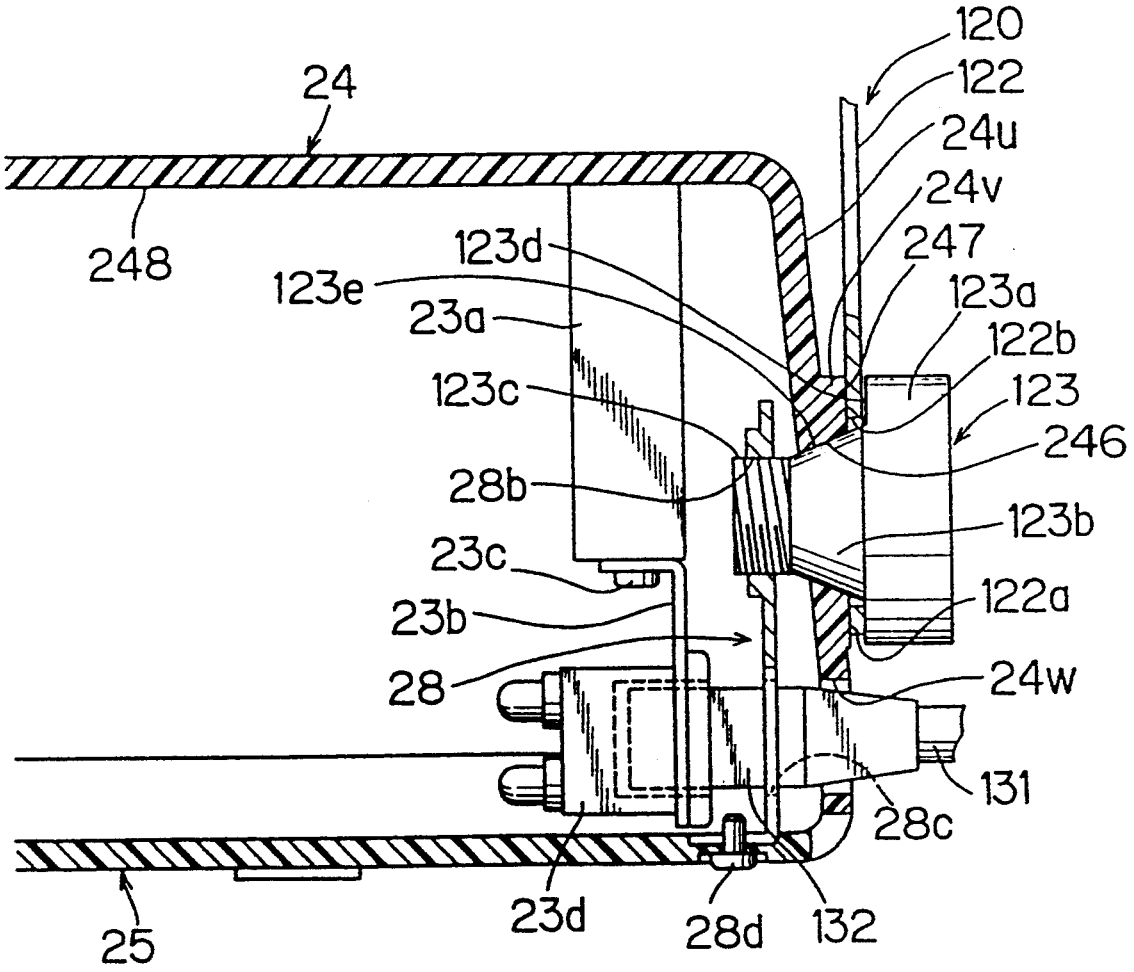
FIG. 29 is a vertical section view of main portions of the electrophotographic copying apparatus in accordance with a third embodiment of the present invention, in which the fitting members are modified.

Referring to FIG. 29, the following description will discuss a third embodiment of the present invention where the fitting members serving as shaft members are modified.

Figure 9:
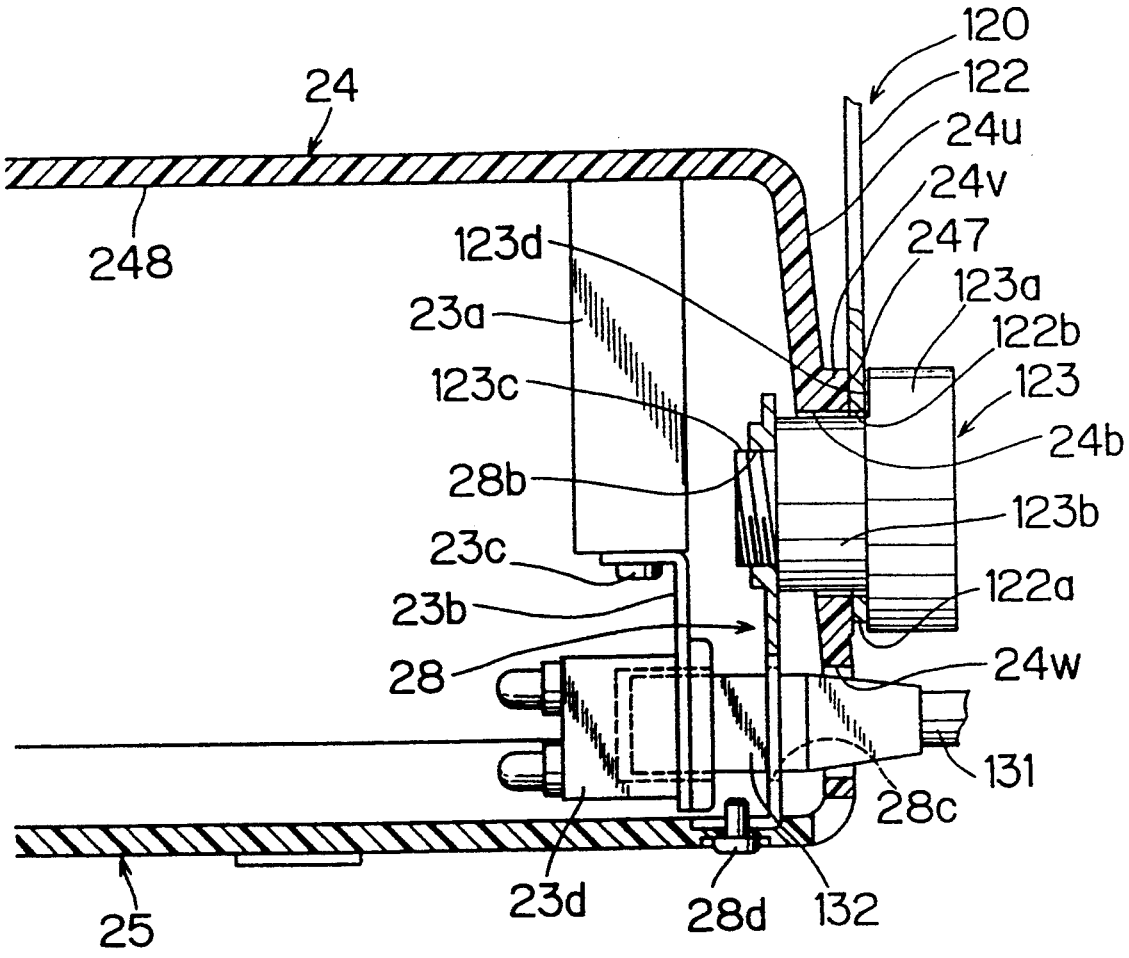
FIG. 9 is a vertical section view of main poritons of the electrophotographic copying apparatus shown in FIG. 1.

The third embodiment differs from the embodiment shown in FIG. 9 in that the fitting members 123 have tapering portions 123*e* which have circular cones gradually reduced in diameter in the direction from the grip portions 123*a* to the screw portions 123*c*, and in that the inner peripheral surfaces of the through-holes 246 of the upper casing 24 are formed by tapering surfaces to be fitted to the tapering portions 123*e*. In the third embodiment in FIG. 29, other arrangements which are the same as those of the embodiment in FIG. 9 are designated by the same reference numerals used in FIG. 9, and the description of such same arrangement is here omitted.

In the embodiment shown in FIG. 29, the fitting members 123 of which tapering portions 123*e* are fitted into the through-holes 246 in the upper casing 24, are threadedly connected to the attaching members 28 secured to the lower casing 25. This enables the casings 24, 25 to be relatively positioned in a more accurate and secure manner.

In the embodiments in FIGS. 9 and 29, fitting members 123 are attached to the attaching members 28 secured to the lower casing 25. However, provision may be made such that the fitting members 123 are attached to attaching members secured to the upper casing 24. In the embodiments in FIGS. 9 and 29, the relative positioning of the casings 24, 25 is made indirectly through the attaching members 28, but can be made directly by the fitting members 123 through no intermediary of the attaching members 28.

Figure 30:
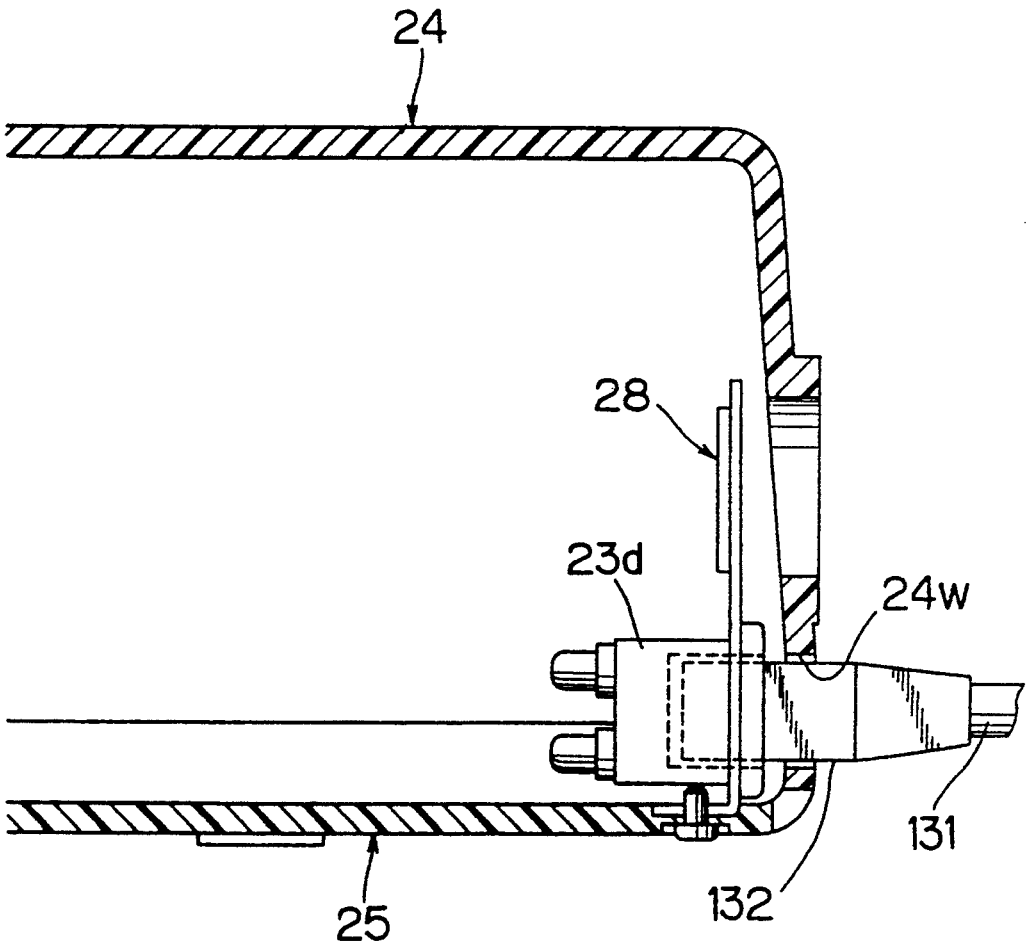
FIG. 30 is a vertical section view of main portions of the electrophotographic copying apparatus in accordance with a fourth embodiment of the present invention.
Figure 31:
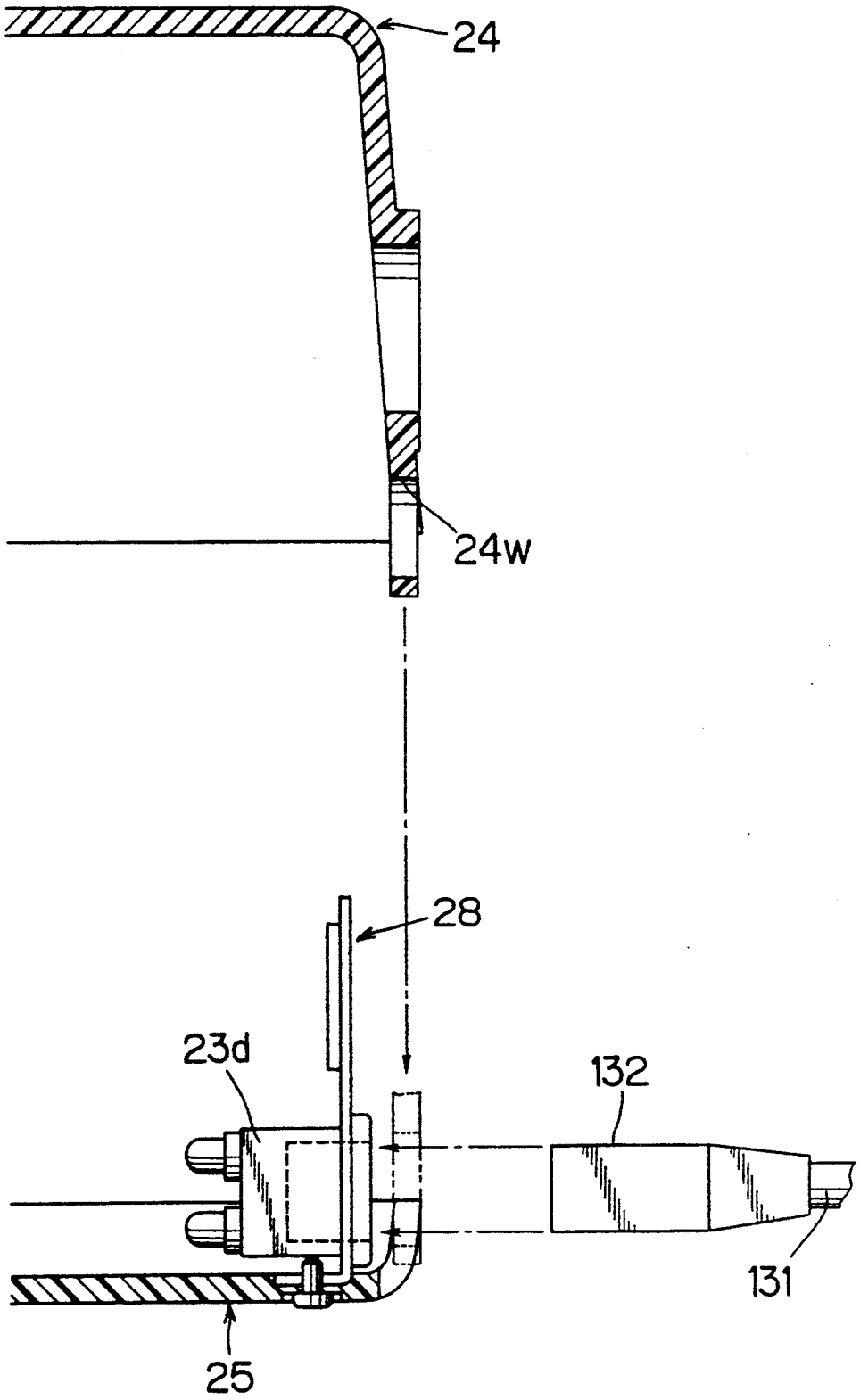
FIG. 31 is an exploded section view of main portions of the apparatus shown in FIG. 30, illustrating the state where the upper casing, the lower casing and the plug are not yet connected to one another.

Another Example Including Provision for Preventing the Casings from Being Separated from Each Other Referring to FIGS. 30 and 31, the following description will discuss a fourth embodiment of the present invention including provision for preventing the casings from being separated from each other.

In the fourth embodiment, the plug connector 23*d* is attached to one of the attaching members 28 secured to the lower casing 25. Thus, this attaching member 28 also serves as a member for attaching the plug connector 23*d*. In this embodiment, the plug 132 serves as opening preventive means. More specifically, the plug 132 as connected to the plug connector 23*d*, is engaged directly with the upper casing 24 and indirectly with the lower casing 25 through the plug connector 23*d* and the attaching member 28 above-mentioned. Thus, the casings 24, 25 are prevented from being separated from each other.

Another Example of Electric Arrangement

Figure 32:
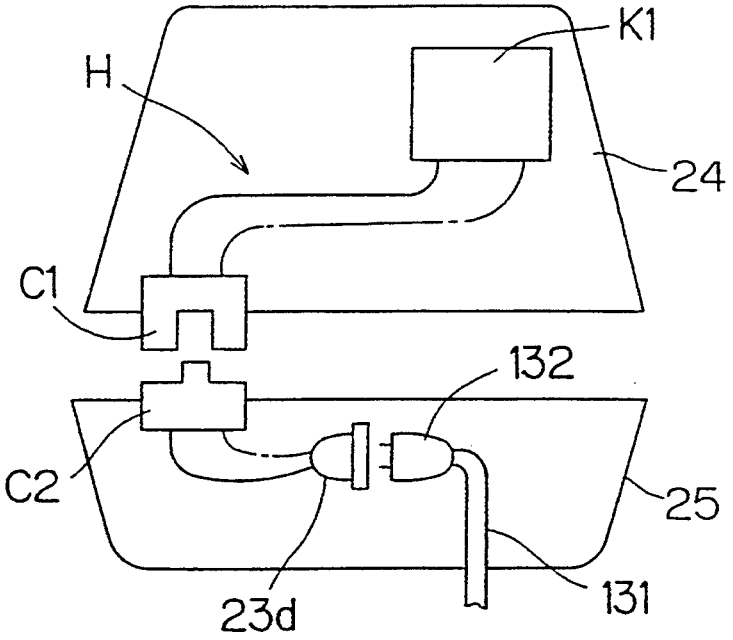
FIG. 32 is a schematic view of the electrophotographic copying apparatus in accordance with a fifth embodiment of the present invention.
Figure 33:
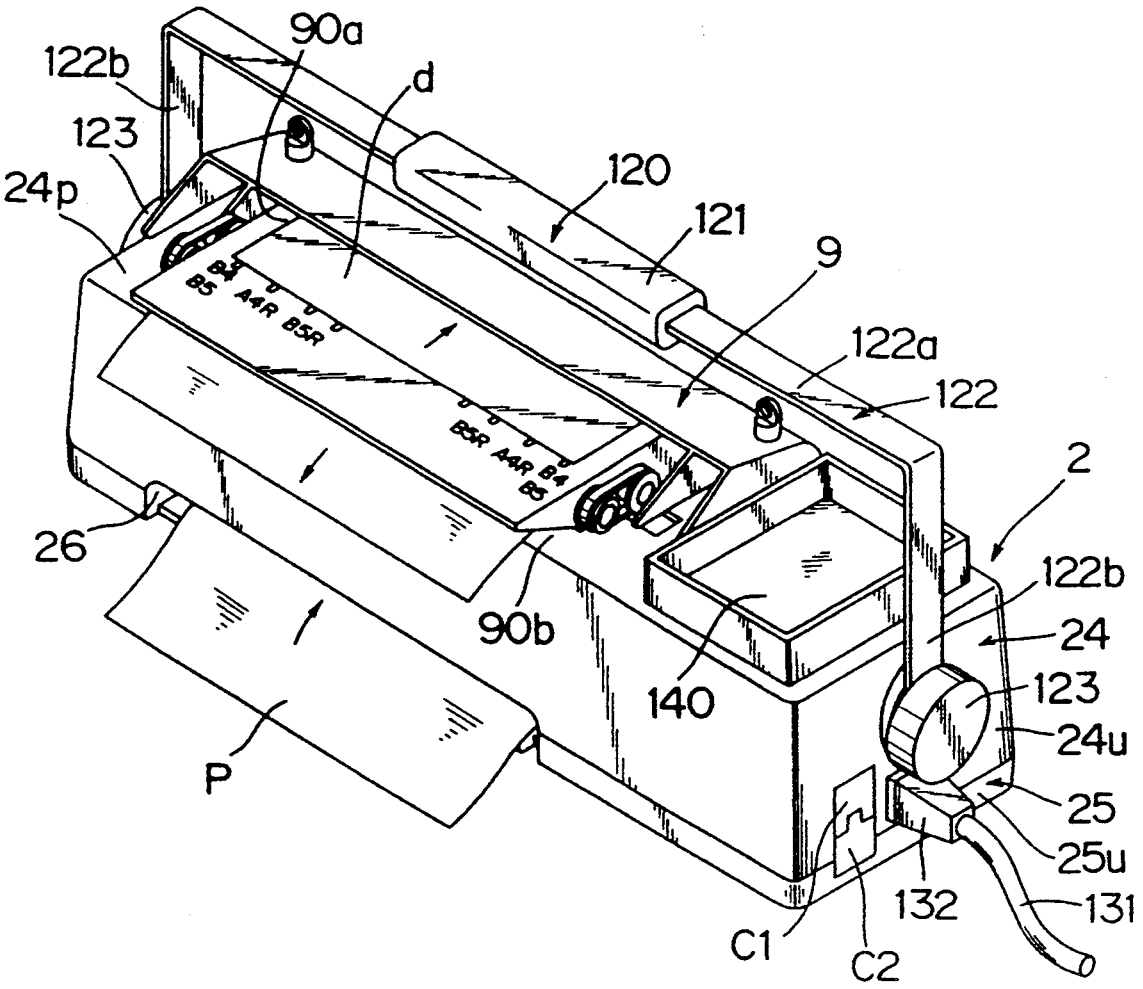
FIG. 33 is a perspective view of the apparatus shown in FIG. 32.
Figure 34:
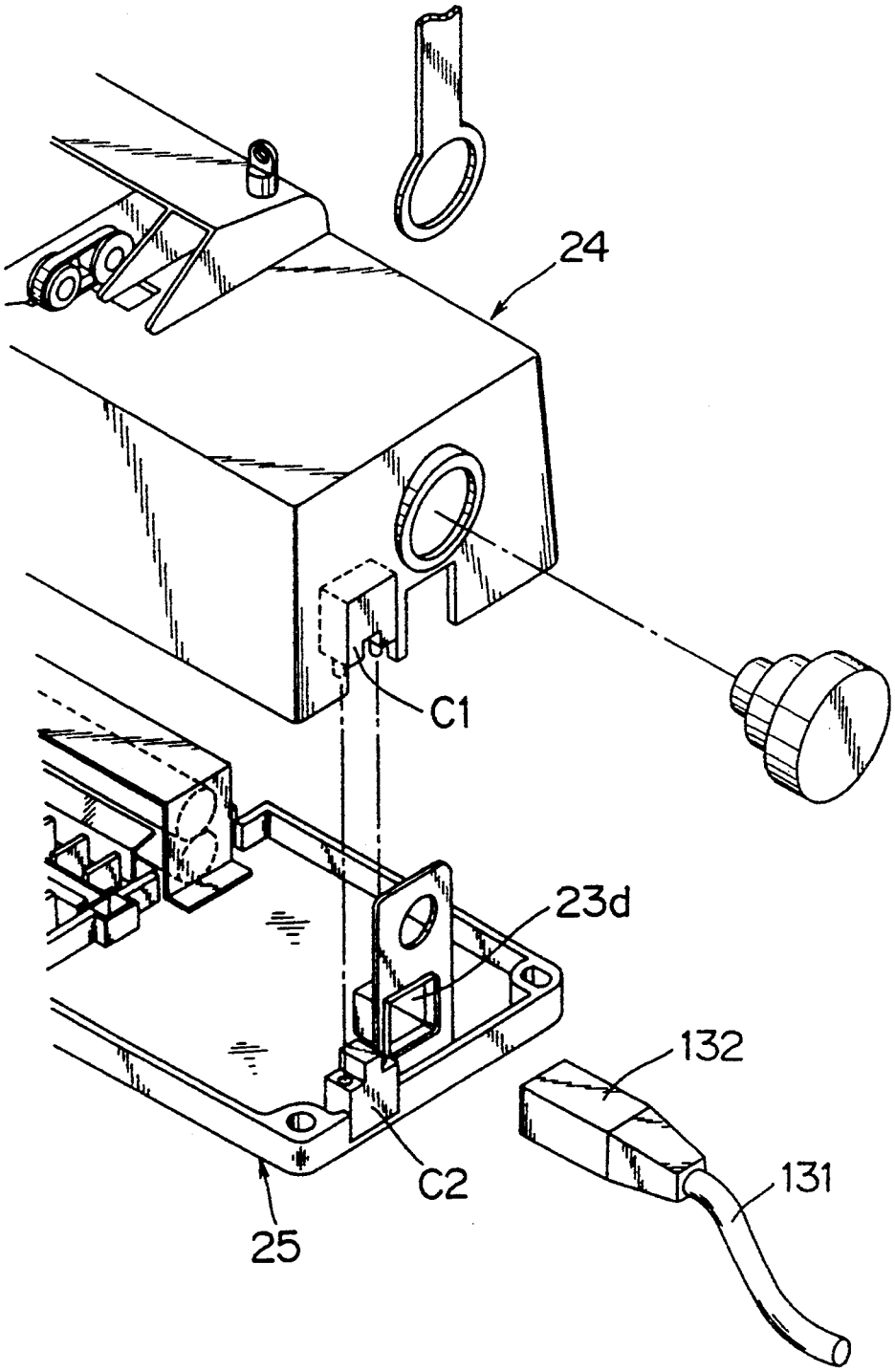
FIG. 34 is an exploded perspective view of main portions of the apparatus shown in FIG. 32.

Referring to FIGS. 32 to 34, the following description will discuss a fifth embodiment of the present invention including modifications of the electric arrangement.

In the fifth embodiment, the plug connector 23*d* is disposed at the lower casing 25. A pair of connectors C1, C2 are disposed in the course of a wire H extending from the plug connector 23*d* to a power transformer K1 as one of the functional components disposed in the upper casing 24. The connector C1 is attached to the upper casing 24, while the connector C2 to be connected to the connector C1 is attached to the lower casing 25. The connectors C1, C2 are adapted to be disconnected from each other in association with the operation of separating the casings 24, 25 from each other, and to be connected to each other in association with the operation of connecting the casings 24, 25.

In the fifth embodiment, the connectors C1, C2 are disconnected from each other following the operation of separating the casings 24, 25 from each other, thus securely disconnecting the transformer K1 from the power supply line 131. This improves the apparatus in safety at the time when the apparatus inside is exposed. This also eliminates the necessity of independently disposing a safety switch which involves the likelihood of erroneous operation and which increases the number of component elements. Thus, the production cost can be reduced.

The connectors C1, C2 are respectively disposed on one of the end surfaces 24*u* of the casing 24 and one of end surfaces 25*u* of the casing 25 such that the connectors C1, C2 can be externally visually recognized. Accordingly, the connection of the both casings 24, 25 to each other can be made while externally visually observing. This facilitates, with safety, the connection of the casings 24, 25 to each other, as well as the connection of the connectors C1, C2 to each other.

Conventionally, such connectors have been disposed inside of the apparatus, or attached to the tips of codes extending from the functional components in the casings. Such arrangement presents the following defects. In the former case, it is difficult to make sure whether the connectors have been properly connected to each other. If the connectors are roughly connected to each other without proper confirmation made, the connectors and/or the functional components might be damaged. In the latter case, after the upper and lower connectors have been connected to each other, the casings are connected to each other while housing the codes in the casings at predetermined places thereof. This involves the likelihood that the codes are held by and between the mutual connection portions of the casings to prevent the casings from being securely connected to each other, or that the codes thus held are cut.

The conventional defects above-mentioned can be overcome in the embodiment in FIGS. 30, 31 where the connectors C1, C2 are respectively attached to the end surfaces 24*u* and 25*u* of the casings 24, 25.

Figure 35:
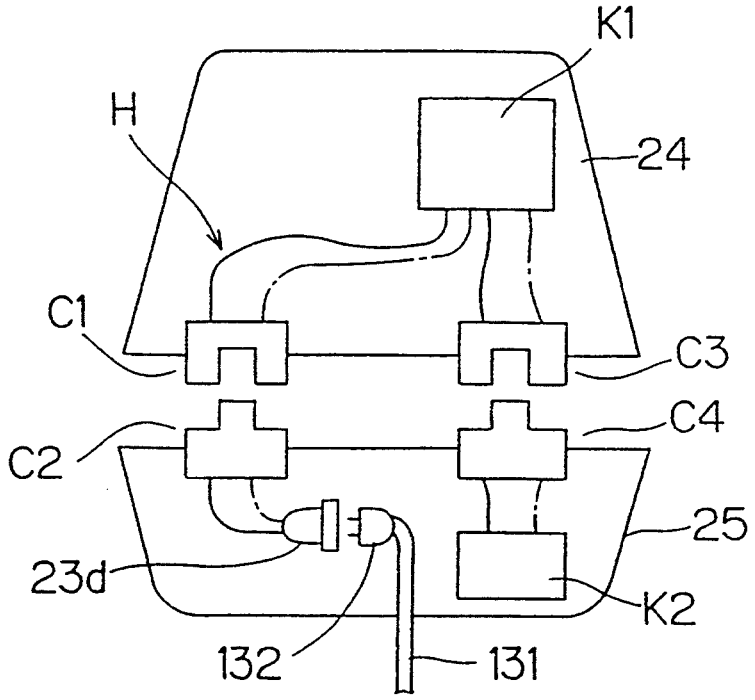
FIG. 35 is a schematic view of the electrophotographic copying apparatus in accordance with a sixth embodiment of the present invention.

Referring to FIG. 35, the following description will discuss a sixth embodiment of the present invention including modifications as to the electric arrangement.

In the sixth embodiment, electric power is supplied from the plug connector 23*d* disposed at the lower casing 25 to the power transformer K1 in the upper casing 24 through a pair of connectors C1, C2, and then supplied from the power tansfomer K1 to other functional components (such as transferring corona discharger and the like) disposed in the lower casing 25 through a pair of connectors C3, C4. The connector C3 is attached to the upper casing 24, while the connector C4 is attached to the lower casing 25. When the casings 24, 25 are separated from each other, the connector C1 is separated from the connector C2, thus disconnecting the power supply line 131 from the power transformer K1, and the connector C3 is separated from the connector C4, thus disconnecting the power transformer K1 from functional components K2.

Figure 36:
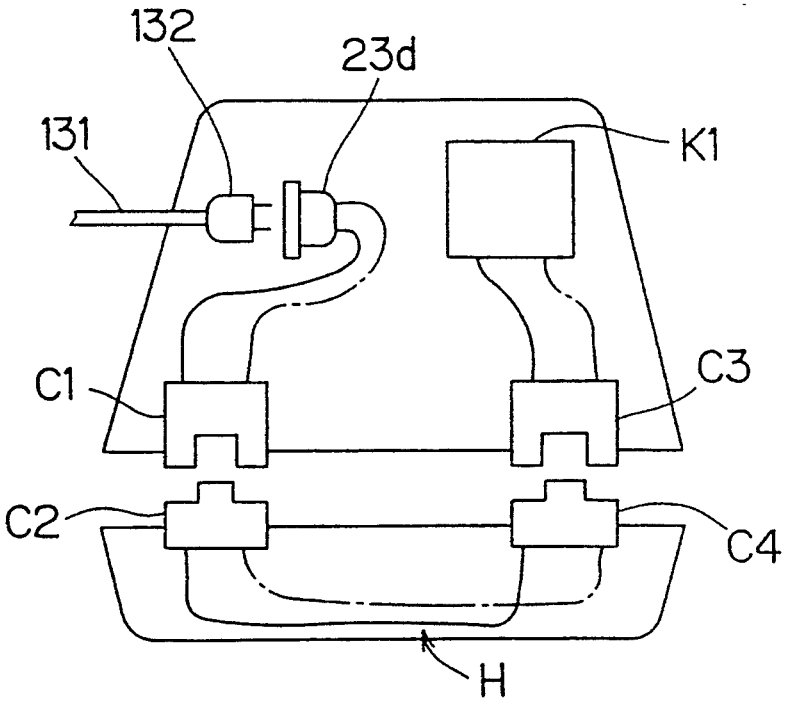
FIG. 36 is a schematic view of the electrophotographic copying apparatus in accordance with a seventh embodiment of the present invention.
Figure 37:
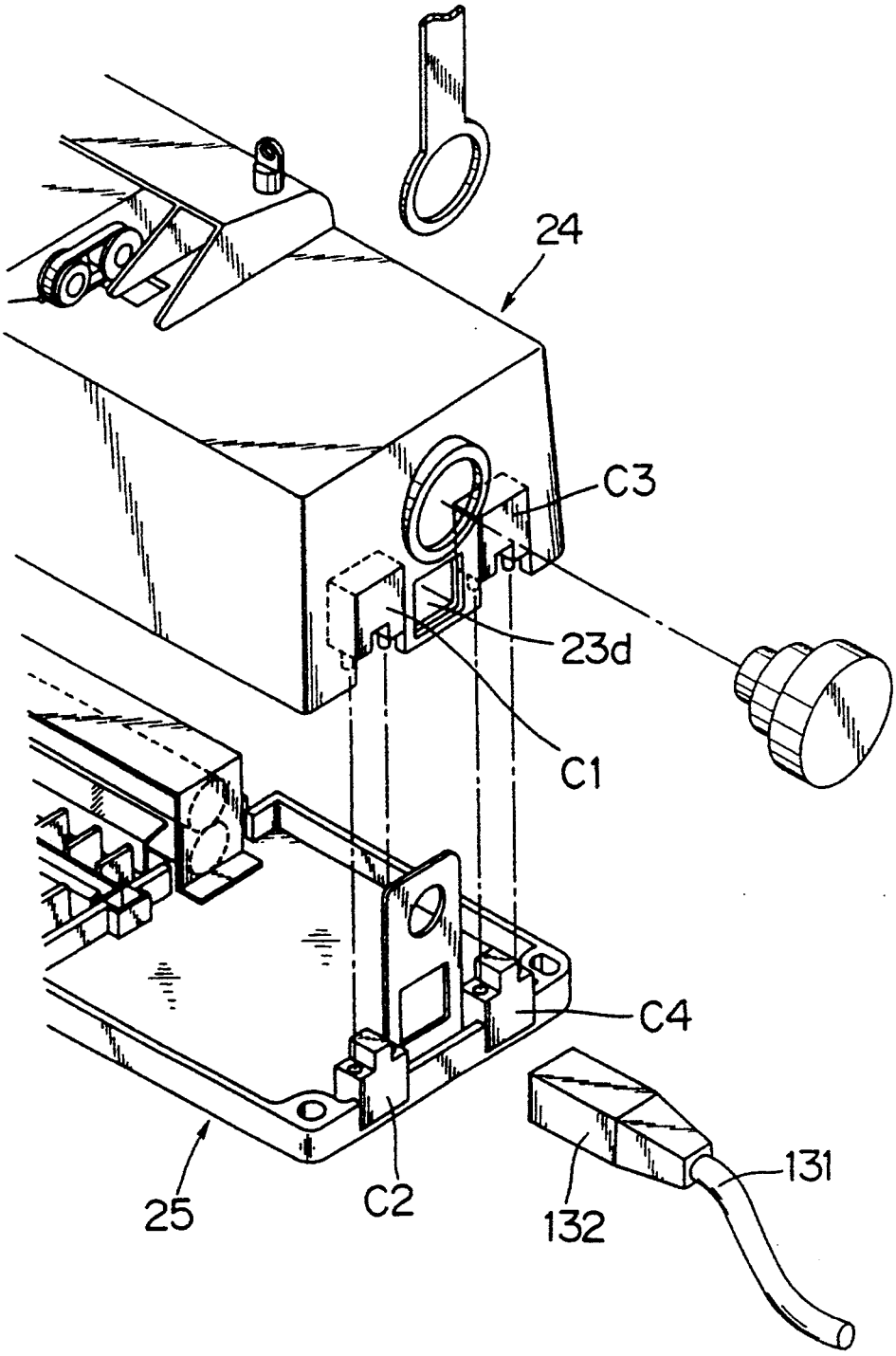
FIG. 37 is an exploded perspective view of main portions of the apparatus shown in FIG. 36.

Referring to FIGS. 36 and 37, the following description will discuss a seventh embodiment of the present invention including modifications as to the electric arrangement.

In the seventh embodiment, the plug connector 23*d* and the power transformer K1 as one of the functional components are disposed in the upper casing 24. The wire H from the plug connector 23*d* is connected to the power transformer K1 once through the lower casing 25. Disposed in the course of the wire H are two pairs of connectors C1, C2 and C3, C4 to be connected to and disconnected from each other simultaneously with the connection and separation of the both casings 24, 25. In this embodiment, too, when the casings 24, 25 are separated from each other, the two pairs of connectors C1, C2 and C3, C4 are separated from each other, thus disconnecting the power supply line 131 from the power transformer K1.

As shown in FIG. 37, the connectors C1, C2, C3, C4 are disposed at the end surfaces 24u, 25*u* of the casings 24, 25 at such positions as to be externally visually recognized.

Figure 38:
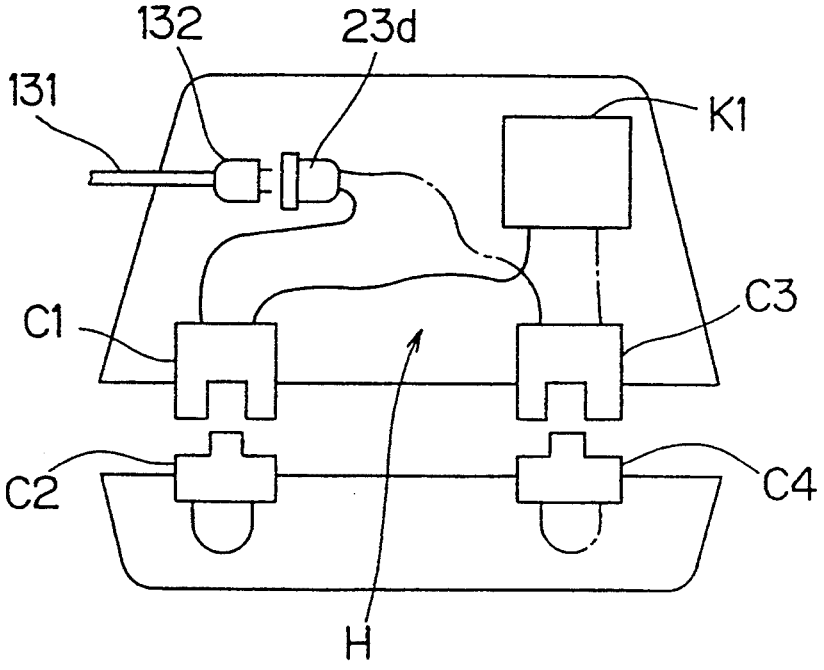
FIG. 38 is a schematic view of the electrophotographic copying apparatus in accordance with an eighth embodiment of the present invention.

In an eighth embodiment of the present invention shown in FIG. 38, provision is made such that the wire H is disposed only in the upper casing 24. In this case, the wiring job can be conducted collectively at the side of the upper casing 24, thus reducing the production cost.

Figure 39:
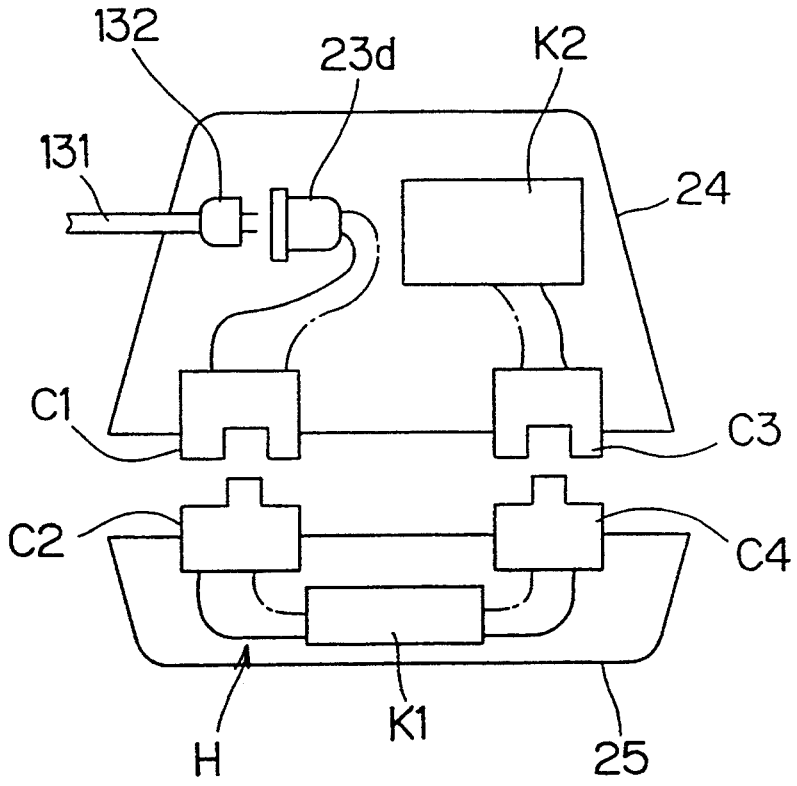
FIG. 39 is a schematic view of the electrophotographic copying apparatus in accordance with a ninth embodiment of the present invention.

Referring to FIG. 39, the following description will discuss a ninth embodiment of the present invention including modifications as to the electric arrangement.

In the ninth embodiment, the power transformer K1 is disposed in the course of the wire H in the lower casing 25. Electric power is supplied from the power transformer K1 to the functional components K2 disposed in the upper casing 24. The plug connector 23*d* is disposed at the upper casing 24. Electric power is supplied from the plug connector 23*d* to the power transformer K1 in the lower casing 25 through a pair of connectors C1, C2, and then supplied from the power transformer K1 to the functional components K2 in the upper casing 24 through a pair of connectors C1, C2.

In this embodiment, too, when the casings 24, 25 are separated from each other, the connectors C1, C3 are separated from the connectors C2, C4, respectively, thus disconnecting the power supply line 131 from the power transformer K1 and disconnecting the power transformer K1 from the functional components K2.

As shown in a variety of embodiments in FIGS. 32 to 39, the safety at the time when the main body 2 is opened with the casings 24, 25 separated from each other, can be assured in a variety of electric arrangements. This enhances the degree of freedom as to the layout of the functional components.

Another Example of the Document Delivery Means

Figure 40:
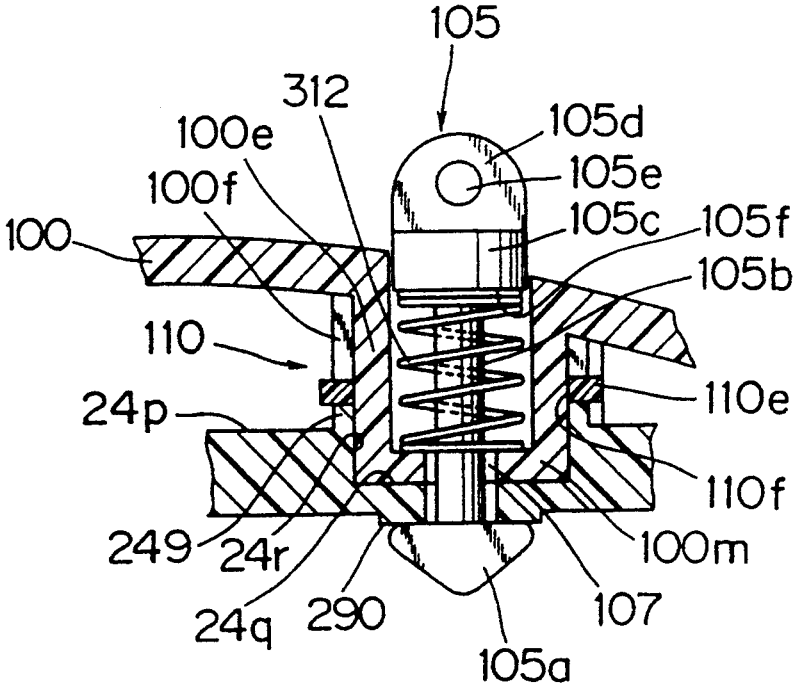
FIG. 40 is a section view of main portions of the electrophotographic copying apparatus in accordance with a tenth embodiment of the present invention, in which the upper and lower covers are attached to the upper casing.
Figure 41:
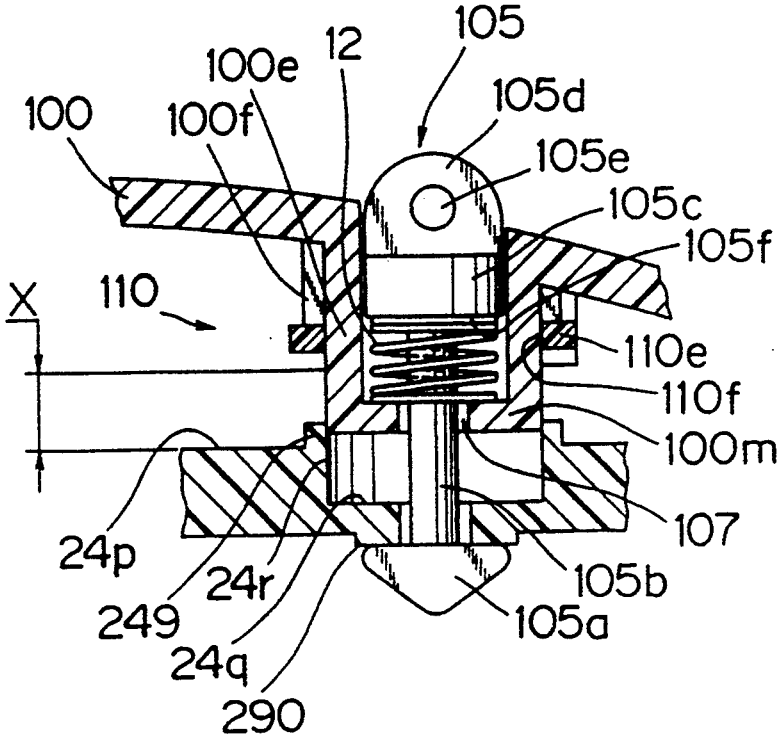
FIG. 41 is a section view of main portions of the apparatus shown in FIG. 40, illustrating how the upper and lower covers are vertically moved.
Figure 42:
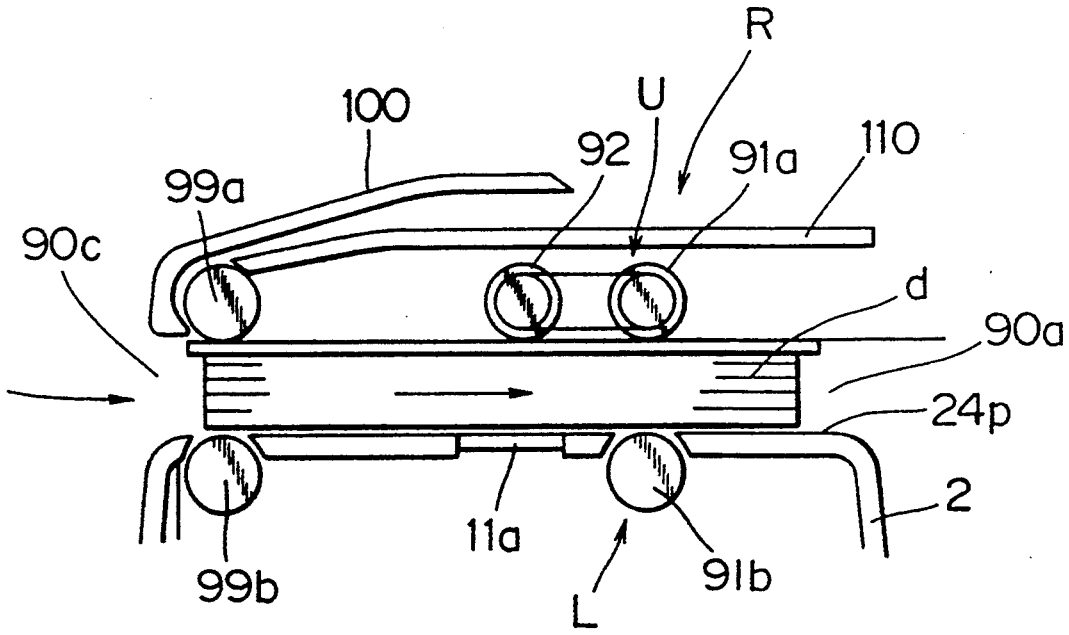
FIG. 42 is a schematic view of main portions of the apparatus shown in FIG. 40, in which a thick document is being copied.
Figure 43:
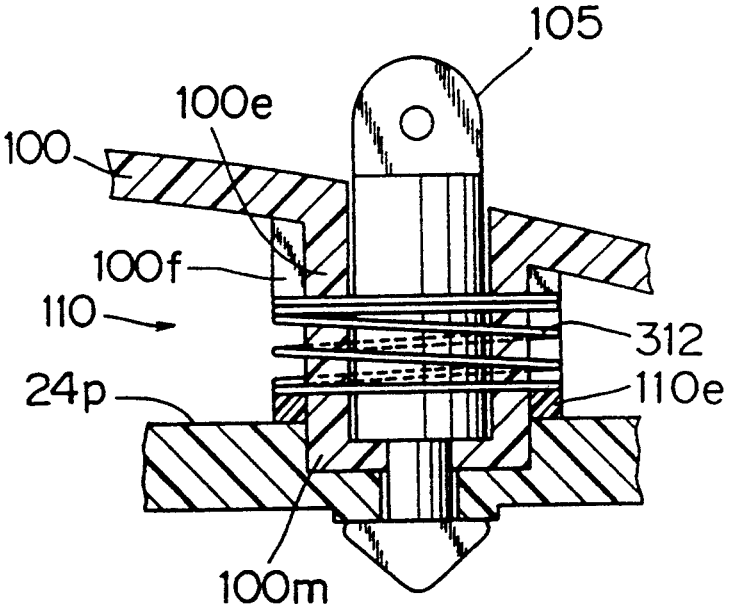
FIG. 43 is a section view of main portions of the electrophotographic copying apparatus in accordance with an eleventh embodiment of the present invention, in which the upper and lower covers are attached to the upper casing.

Referring to FIGS. 40 to 42, the following description will discuss a tenth embodiment of the present invention including modifications of the document delivery means. The tenth embodiment differs in arrangement from the embodiment in FIG. 21 in the following four points i) to iv).

i) Annular step portions 249 are formed around the through-holes 24*r* in the top surface 24*p* of the upper casing 24.

ii) The stay portions 110*e* of the lower cover 110 are held by and between the ribs 100*f* of the upper cover 100 and the step portions 249. The upper and lower covers 100, 110 are vertically positioned by the top surfaces of the step portions 249.

iii) Helical compression springs 312 serving as biasing means are put around the smaller-diameter portions 105*b* of the connecting members 105. The helical compression springs 312 are disposed between the top surfaces of the bottoms 100*m* of the boss portions 100*e* of the upper cover 100 and the underside surfaces of the trunk portions 105*c* of the connecting members 105.

iv) Instead of the cam surfaces 29 with which the arrowhead-like portions 105*a* of the connecting members 105 are engaged, flat surfaces 290 are used, and the arrowhead-like portions 105*a* are engaged with the upper casing 24 by the resiliency of the helical compression springs 312.

Referring to FIGS. 41 and 42, when reproducing a particularly thick document d such as a note, a pocket notebook or the like, the document d is inserted from the opening 90*c* at the rear side of the main body 2 as done in the embodiment in FIG. 27. The document d is inserted until the tip of the document d reaches the contact portions of the upper delivery rollers 99*a* with the lower delivery rollers 99*b*. With the document d thus set, the reproduction start switch is turned on, and the document d as held by and between the delivery rollers 99*a*, 99*b*, is then delivered toward the upper delivery roller 92 by the delivery rollers 99*a*, 99*b*.

As shown in FIG. 42, the helical compression springs 312 put on the smaller-diameter portions 105*b* of the connecting members 105 are compressed according to the thickness of the document d, so that the lower cover 110 serving as the holding means, the upper cover 100 serving as means for supporting the lower cover 110 and the upper roller means U (that is, the upper delivery rollers 99*a*, 92, 91*a* and the roller shafts 99*c*, 94, 91*c*) are integrally moved upward. Accordingly, the distances between the upper delivery rollers 99*a*, 91*a* and the lower delivery rollers 99*b*, 91*b* are automatically adjusted according to the thickness of the document d. It is therefore not required to previously adjust such distances.

While pushed to the top surface 24*p* of the upper casing 24 by the resiliency of the helical compression springs 312, the document d is delivered along the transparent platen 11*a* and then discharged from the document discharge port 90*b*. After the thick document d has been discharged, the upper cover 100 and the lower cover 110 are returned to the original positions by the resiliency of the helical compression springs 312 as shown in FIG. 40. The heights of the annular step portions 249 are set such that, even though the upper cover 100 and the lower cover 110 are upwardly moved at maximum, the boss portions 100*e* of the upper cover 100 are not pulled out from the through-holes 24*r*. Thus, a particularly thick document d can be readily reproduced. Further, cam surfaces to be engaged with the arrowhead-like portions 105*a* can be eliminated.

Referring to FIG. 44, the following description will discuss an eleventh embodiment of the present invention including modifications of the document delivery means. In the eleventh embodiment, (i) the upper cover 100 is fixed, in a vertically immobile manner, to the top surface 24*p* of the upper casing 24 by the connecting members 105, and (ii) the helical compression springs 312 serving as biasing means as put on the outer peripheries of the boss portions 100*e* of the upper cover 100, are disposed between the underside surfaces of the ribs 100*f* of the upper cover 100 and the top surfaces of the stay portions 110*e* of the lower cover 110.

In the embodiment shown in FIG. 40, when reproducing a particularly thick document, the upper roller means U including the upper delivery rollers 99*a*, 92, 91*a*, the upper cover 100 and the lower cover 110 are integrally moved. In the embodiment shown in FIG. 44, however, the upper cover 100 is not moved and the upper roller means U including the upper delivery rollers 99*a*, 92, 91*a* and the lower cover 110 are integrally moved. In this embodiment, too, a particularly thick document such as a note, a pocket notebook or the like can be readily reproduced.

What is claimed is:

1. An image forming apparatus, comprising:
optical means for illuminating a document and for projecting an image corresponding to said document on a photoreceptor;
image forming means for forming an electrostatic latent image on the photoreceptor based on said image projected by said optical means, for converting said electrostatic latent image into a toner image and for transferring said toner image to paper;
paper delivery means including a fixing unit for fixing said toner image transferred to said paper, said paper delivery means being adapted to introduce paper inside of a main body of said apparatus and for discharging the paper from said main body through said image forming means;
drive means for driving said image forming means and said paper delivery means; and
electric components;
wherein said main body is made of a resin which houses said optical means, said image forming means, said paper delivery means and said drive means, said main body being formed from separable upper and lower casings each made in a monocoque structure,
said upper casing being provided at an upper part thereof with document delivery means including a pair of delivery rollers for delivering a document along a top surface of said upper casing while said document is held by and between said pair of delivery rollers;
wherein the length of the document delivery means along the document delivery direction is shorter than the length of said document delivery means along the direction at a right angle to said document delivery direction,
the main body of said apparatus is made substantially in the form of a rectangular parallelepiped which is long in the longitudinal direction of said document delivery means, and
said main body has at least one handle with which said main body can be carried with the longitudinal ends of said main body supported by said handle.

2. An image forming apparatus according to claim 1, wherein the handle is made in a U shape by which longitudinal ends of the main body of said apparatus are held, said handle being rotatable around an axis of rotation parallel with the longitudinal direction of said main body.

3. An image forming apparatus according to claim 2, wherein the handle is formed integrally with each of the longitudinal ends of the upper casing.

4. An image forming apparatus according to claim 1, further comprising regulating means for regulating rotation of the handle in a predetermined rotational angle such that a predetermined part of a document delivered by the document delivery means is supported by said handle.

5. An image forming apparatus, comprising:
optical means for illuminating a document and for projecting an image corresponding to said document on a photoreceptor;
image forming means for forming an electrostatic latent image on the photoreceptor based on said image projected by said optical means, for converting said electrostatic latent image into a toner image and for transferring said toner image to paper;
paper delivery means including a fixing unit for fixing said toner image transferred to said paper, said paper delivery means being adapted to introduce paper inside of a main body of said apparatus and for discharging the paper from said main body through said image forming means;
drive means for driving said image forming means and said paper delivery means; and
electric components;
wherein said main body is made of a resin which houses said optical means, said image forming means, said paper delivery means and said drive means, said main body being formed from separable upper and lower casings each made in a monocoque structure,
one of said upper and lower casings having boss portions located proximate at least four corners of said casing,
the other casing having concaves adapted to receive said boss portions,
said upper casing being provided at an upper part thereof with document delivery means including a pair of delivery rollers for delivering a document along a top surface of said upper casing while said document is held by and between said pair of delivery rollers;
wherein said upper and lower casings are relatively positioned with respect to each other in the front-to-back direction and the transverse direction by said boss portions and said concaves fitted thereto, and
the main body of said apparatus is provided at the ends thereof with a pair of shaft members, said upper and lower casings being vertically positioned with respect to each other with said shaft members inserted into through-holes formed in both end surfaces of one of said upper and lower casings and with said shaft members directly or indirectly engaged with the other casing.

6. An image forming apparatus according to claim 5, further comprising a handle made in a U shape by which the longitudinal ends of the main body of said apparatus are held and with which said main body can be carried with said longitudinal ends of said main body supported by said handle, said handle being attached to said longitudinal ends of said main body by the shaft members.

7. An image forming apparatus according to claim 6, wherein
said other casing has attaching members to which the shaft members are attached, and
said shaft members have (i) screw portions threadedly connected to screw holes formed in said attaching members, and (ii) tapering portions securely fitted into the through-holes in said one casing as said screw portions are threadedly connected to said screw holes.

8. An image forming apparatus according to claim 5, wherein the boss portions are formed at the upper casing at a lowermost position thereof, such that said upper casing can be supported on a flat surface when separated from said lower casing.

9. An image forming apparatus according to claim 5, wherein
the boss portions are formed at the upper casing, and
resilient members are disposed in the concaves formed in the lower casing, said resilient members being adapted to lift up said boss portions in a direction away from said concaves when the casings are disengaged from one another.

10. An image forming apparatus, comprising:

optical means for illuminating a document and for projecting an image corresponding to said document on a photoreceptor;

image forming means for forming an electrostatic latent image on the photoreceptor based on said image projected by said optical means, for converting said electrostatic latent image into a toner image and for transferring said toner image to paper;

paper delivery means including a fixing unit for fixing said toner image transferred to said paper, said paper delivery means being adapted to introduce paper inside of a main body of said apparatus and for discharging the paper from said main body through said image forming means;

drive means for driving said image forming means and said paper delivery means; and electric components;

wherein said main body is made of a resin which houses said optical means, said image forming means, said paper delivery means and said drive means, said main body being formed from separable upper and lower casings each made in a monocoque structure, said upper casing being provided at an upper part thereof with document delivery means including a pair of delivery rollers for delivering a document along a top surface of said upper casing while said document is held by and between said pair of delivery rollers; wherein the document delivery means includes:

roller means for delivering a document along the top surface of the main body of said apparatus, said roller means including upper roller means adapted to come in contact with the top surface of the document and lower roller means adapted to come in contact with the underside of the document;

holding means for rotatably holding said upper roller means; and supporting means for supporting said holding means together with said upper roller means;

said holding means and said supporting means being connected to said main body by stretchable connecting means such that at least said holding means is vertically movable together with said upper roller means according to the thickness of the document.

11. An image forming apparatus according to claim 10, wherein the holding means is formed by a lower cover which partially covers the top surface of the upper casing and which forms, between said lower cover and said top surface, a lower delivery passage for delivering a document along said top surface, and said supporting means is formed by an upper cover which covers, at least partially, said lower cover and which forms, between said upper cover and a top surface of said lower cover, an upper delivery passage for delivering a document in a direction opposite to a document delivery direction in said lower delivery passage.

12. An image forming apparatus according to claim 11, wherein the upper roller means includes upper delivery rollers, wherein peripheral surfaces of the upper delivery rollers are adapted to come in contact with a top surface of a document, and roller shafts for supporting said upper delivery rollers;

the lower cover is made of a resin;

said lower cover is provided at an underside thereof with hanging pieces having circular concaves for supporting said roller shafts;

each of said hanging pieces including a pair of projecting pieces between which a cut groove is formed communicating with each of said concaves in said hanging pieces, said cut groove being formed for introducing each of said roller shafts into each of said concaves, wherein a width of said cut groove is narrower than the diameters of said roller shafts at a time when said roller shafts are introduced in said concaves, and the width of said cut groove being broadened by resilient deformation of said pairs of projecting pieces such that said roller shafts are introduced through said cut grooves.

13. An image forming apparatus according to claim 11, wherein the connecting means include first engagement portions engaged with predetermined portions of at least one of the upper and lower covers, and second engagement portions engaged with an underside of the top surface of the upper casing.

14. An image forming apparatus according to claim 13, further comprising biasing means disposed between predetermined portions of one of the upper and lower covers and the first engagement portions of the connecting means when said upper and lower covers are attached to the main body of said apparatus by said connecting means, said biasing means being disposed for biasing at least said lower cover downwardly.

* * * * *